US007395574B2

(12) United States Patent
McKay

(10) Patent No.: US 7,395,574 B2
(45) Date of Patent: Jul. 8, 2008

(54) LINT REMOVAL APPARATUS WITH EDGE ORIENTATION

(75) Inventor: William D. McKay, Grand Blanc, MI (US)

(73) Assignee: The Hartz Mountain Corporation, Secaucus, NJ (US)

( * ) Notice: Subject to any disclaimer, the term of this patent is extended or adjusted under 35 U.S.C. 154(b) by 0 days.

(21) Appl. No.: 11/805,626

(22) Filed: May 23, 2007

(65) Prior Publication Data

US 2007/0220691 A1 Sep. 27, 2007

Related U.S. Application Data

(63) Continuation of application No. 10/672,909, filed on Sep. 26, 2003, now Pat. No. 7,234,188.

(51) Int. Cl.
*A47L 25/08* (2006.01)

(52) U.S. Cl. ..... 15/104.002

(58) Field of Classification Search ..... 15/104.002
See application file for complete search history.

(56) References Cited

U.S. PATENT DOCUMENTS

| | | | | |
|---|---|---|---|---|
| 2,127,886 | A | 8/1938 | Plon | |
| 2,271,189 | A | 1/1942 | Garthwait | |
| 2,363,647 | A | 11/1944 | Cosin | |
| 2,506,333 | A | 5/1950 | Bedynek | |
| 2,612,336 | A | 9/1952 | Tuttle | |
| 2,758,327 | A * | 8/1956 | Kennon | 15/104.002 |
| 2,888,698 | A | 6/1959 | Kaye et al. | |
| 2,920,334 | A | 1/1960 | Keller | |
| 2,922,180 | A | 1/1960 | Render | |
| 3,011,499 | A | 12/1961 | Tajan | |
| 3,034,376 | A | 5/1962 | Gonzalez | |
| 3,056,154 | A | 10/1962 | Neal | |
| 3,060,485 | A | 10/1962 | Butter et al. | |
| 3,102,544 | A | 9/1963 | Keegan et al. | |
| 3,128,487 | A | 4/1964 | Vallis | |
| 3,158,887 | A | 12/1964 | Kanbar et al. | |
| 3,299,461 | A | 1/1967 | Marks | |
| 3,373,457 | A | 3/1968 | Rouch, Jr. | |
| D216,942 | S | 3/1970 | Safalow | |
| 3,665,543 | A | 5/1972 | Nappi | |
| 3,742,547 | A * | 7/1973 | Sohmer | 15/104.002 |
| 3,798,698 | A | 3/1974 | Conklin, Jr. | |
| D238,127 | S | 12/1975 | Snyder | |
| 4,062,083 | A | 12/1977 | McKay | |
| 4,107,811 | A | 8/1978 | Imsande | |
| 4,244,587 | A | 1/1981 | Schweizer | |
| 4,357,730 | A | 11/1982 | Lex | |
| 4,361,923 | A * | 12/1982 | McKay | 15/104.002 |
| 4,399,579 | A | 8/1983 | McKay | |
| 4,422,201 | A | 12/1983 | McKay | |

(Continued)

*Primary Examiner*—Randall Chin
(74) *Attorney, Agent, or Firm*—Gottlieb, Rackman & Reisman

(57) ABSTRACT

A lint roll apparatus includes an orienting mechanism for orienting the free edge of the outermost sheet of a adhesive roll with a predetermined point on a roll support. Orientation is implemented by cooperating stop members on the roll and the roll support, by a slidable member on the roll support moveable into and out of engagement with a notch in the roll or a roll core, or a trigger activated moveable pin which is engagable with a stop member carried on the roll or roll support. A motor driven spindle rotates a cylinder on which the roll is mounted.

4 Claims, 19 Drawing Sheets

U.S. PATENT DOCUMENTS 4,489,912 A 12/1984 Haythornthwaite
4,500,939 A 2/1985 Gueret
4,517,703 A 5/1985 Koke
4,519,566 A 5/1985 Manzi
4,603,448 A 8/1986 Middleton et al.
4,727,616 A 3/1988 Kucera et al.
4,742,547 A 5/1988 Watanabe
4,850,073 A 7/1989 Preuss
4,856,541 A 8/1989 Kellett et al.
4,884,688 A 12/1989 Hurst
4,905,337 A 3/1990 McKay
D311,995 S 11/1990 Garcia
D314,282 S 2/1991 Gingras
5,027,465 A 7/1991 McKay
D320,680 S 10/1991 Stetson et al.
5,052,071 A 10/1991 Halm
D342,610 S 12/1993 Stetson et al.
5,392,482 A 2/1995 Drulias et al.
5,410,772 A 5/1995 Lewis
D363,214 S 10/1995 Parola et al.
5,651,158 A 7/1997 Halm
5,819,989 A 10/1998 Saraceni
5,878,457 A 3/1999 Cox et al.
5,924,157 A * 7/1999 Barela ..... 15/104.002
5,940,921 A 8/1999 Wood et al.
6,006,393 A 12/1999 Lynch et al.
D419,306 S 1/2000 Hansen et al.
6,014,788 A 1/2000 Jaffri
6,021,542 A 2/2000 Norman
6,055,695 A 5/2000 McKay, Jr.
6,098,635 A 8/2000 Marino
6,127,014 A 10/2000 McKay, Jr.
D441,538 S 5/2001 Petner
D446,023 S 8/2001 Sherman
6,298,517 B1 10/2001 McKay
6,321,408 B1 11/2001 Esterson et al.
6,325,070 B1 12/2001 Tyroler et al.
6,405,403 B1 6/2002 McKay
6,427,278 B1 * 8/2002 McKay, Jr. ..... 15/104.002
6,493,899 B1 12/2002 Hintz et al.
6,756,102 B1 6/2004 Galo
7,020,926 B2 * 4/2006 McKay ..... 15/104.002
7,039,982 B1 * 5/2006 McKay ..... 15/104.002
2002/0144367 A1 10/2002 McKay, Jr.
2003/0089632 A1 * 5/2003 Jessen et al. ..... 206/389
2003/0096074 A1 5/2003 Kim
2004/0052570 A1 * 3/2004 McKay ..... 401/219
2004/0154133 A1 8/2004 Polzin et al.
2004/0177459 A1 * 9/2004 McKay ..... 15/104.002
2004/0194240 A1 10/2004 McKay, Jr.
2005/0184099 A1 * 8/2005 McKay ..... 222/192

* cited by examiner

LINT REMOVAL APPARATUS WITH EDGE ORIENTATION

This application is a continuation of U.S. application Ser. No. 10/672,909, filed Sep. 26, 2003, now U.S. Pat. No. 7,234, 188.

BACKGROUND

This invention relates to pressure sensitive adhesive tape rolls longitudinally wound with outwardly facing adhesive.

Such tapes are used for picking up undesired particles from fabric, floor and other surfaces. More specifically, the pressure sensitive adhesive tape roll is provided with an adhesive formulated in such a way to efficiently pick up and hold foreign particles over which it is rolled and then optionally cleaned either by rinsing the particles away from the adhesive or peeling the soiled outermost layer away using one of the peeling systems in the art.

Some devices of the prior art illustrate the use of tape rolls which utilize specific perforation, slit, and non-adhesive edge patterns to promote easy sheet removal. Some of the tape utilizes creped paper, flat back paper, or silicone treated paper, which when becoming wet deteriorates. Other lint removers use embossed film with adhesive coating to build the roll's diameter.

Other devices known in the art utilize a rubber like sticky washable coating that is extruded onto a core and then placed onto a lint roller assembly. While this provides for cleaning the sticky roll with water it does not provide the peeling option. Even with a dry edge or pop-up tab, the tight wound nature of the lint roll and the potentially long time over which a single roll is used can cause even the dry edges to stick to the underlying sheet.

As with any roll of tape, locating the end of the tape can be a time consuming task in addition to the difficulty in prying an edge of the end away from the remainder of the tape roll.

Lint rollers typically have a lint roll rotatably mounted on a body from which a handle extends. The lint roll is rolled across a surface to be cleaned. Centrifugal force resulting from the speed at which the user moves the roller across the surface frequently causes the roll to continue to rotate even when after separation from a surface. As the distance the user moves the roll across a surface can vary from application to application and due to centrifugal force, the free end of the tape roll continually changes position about the circumference of the roll with respect to the underlying body and handle. This makes it difficult to locate the ever-changing location of the free end in order to remove the soiled outermost sheet from the roll.

Thus, it would be desirable to provide a lint roller apparatus which has an edge orienting capability in which the free end of the tape roll is always oriented in the same location with respect to the handle and roller body or swivel. It would also be desirable to provide a lint roller apparatus in which the free end of the lint roll can be oriented to a established, constant position by the user after a cleaning operation. It would also be desirable to provide a lint roller apparatus which has an automatic rotation means for automatically rotating the cleaning element with respect to the handle. It would also be desirable to provide a lint roller apparatus which includes a means for prying the free edge of the outermost sheet of the tape roll from the underlying sheet during rotation of the roll.

SUMMARY

The present invention is a cleaning apparatus which may use outwardly facing, separable, adhesive sheets wound in a roll and rotatably mounted on a support having a handle, and which includes a unique orienting means for orienting the separable edge of the outermost sheet on the roll with an orientation or registration point on the roll support for ease in locating the edge for removal of the outermost sheet from the roll.

In one aspect, a cleaning apparatus includes a wound roll with outward facing adhesive surfaces, the roll formed of a plurality of separable sheets, each defined by an edge separable from an adjacent sheet, a roll support rotatably supporting the roll and means, carried on at least one of the roll and the roll support, for orienting the edge of each sheet, as the edge of each sheet becomes the outermost edge of the roll, with a predetermined registration indicia on the support.

A predetermined registration indicia is an indicia carried on the support.

In one aspect, the orienting means includes a projection carried on the support and engagable with a notch on the roll. In this respect, the roll has an inner core, the notch formed on the core. In a related aspect with the notch is formed on one side edge of the roll.

In another aspect, the projection is carried on a member slidably mounted on the support and moveable between a first position engaged with the notch and a second position spaced from the roll and notch.

In another aspect, the orienting means includes a projection carried on the support, a bore formed in the roll, the projection engagable with the bore to stop rotation of the roll through stoppage of rotation of the support when the roll edge is at the registration indicia.

In another aspect, the support includes a handle and a spindle axially fixedly extending from the handle, a rotatable member rotatably mounted on the spindle, the roll mounted on the rotatable member. The orienting means includes a projection on one of the handle in the rotatable member, and spaced members carried on the other of the handle on the rotatable member and defining the channel for receiving the projection to lock the rotatable member from rotation with respect to the handle. The orienting means can include a projection carried on the spindle, and a latch member carried on the rotatable member and engagable with the projection to stop rotation of the rotatable member.

Further, the rotatable member has an end member adjacent to the handle. Stop means are carried on the end members. A latch member is moveably carried on the handle. A trigger is moveably mounted on the handle and coupled to the latch member for moving the latch member between a first position engaged with the stop means to stop rotation of the rotatable member and a second position spaced from the end member permitting rotation of the rotatable member. The stop means includes an annular recess formed in the end member, a detent formed in the recess, and the latch member comprising a pin having an end engaged with the recess and moveable into the detent upon movement of the trigger to the second position. Further, biasing means are provided for normally biasing the trigger to the first position. In this aspect, the stop means includes a stop member mounted on the end member of the rotatable member; a pin having an end disposed in the path of movement of the stop member, the pin moveable upon movement of the trigger to the second position, to move from a first position spaced from the end member to a second position in interference with the stop member for stopping rotation of the rotatable member.

In another aspect, means are carried in the support for rotating the spindle. The rotating means includes an axle extending from the rotatable member, a trigger moveably mounted on the handle and moveable between a first and second position, and gear means carried on the axle and the trigger to translate pivotal movement of the trigger when moving between the first and second positions to rotation of the rotatable member in at least one direction to bring the next sequential edge on the roll to the registration indicia. The gear means may include meshing gears carried on the axle and the trigger. Biasing means may be engaged with the trigger for normally biasing the trigger to the first position.

In another aspect, the rotating means includes power drive means, carried in the support, the drive means having a rotatable output shaft, a power source selectively coupled to the drive means, a rotatable member coupled to and rotatable with the roll, and means for coupling the output shaft to the rotatable member.

The coupling means comprises a gear transmission.

In another aspect, edge separator means is carried on the handle and adapted for engagement with the roll to separate the endmost edge of the outermost sheet of the roll from the roll. The edge separator means may be a blade carried on the handle and moveable into engagement with the roll. The blade may be slidably mounted on the handle. Biasing means may be engaged with the blade for biasing the blade in the direction toward the roll. Means may also act on the blade to bias the blade away from the roll.

The present cleaning apparatus uniquely provides an orienting means for orienting the free end of the outermost sheet on the roll at a constant, determined registration or orientation location or point on the roller apparatus for ease in locating the free edge to simplify and speed up the removal of the outermost sheet from the roll. The orienting means can be implemented in a number of different mechanisms, all of which are easily incorporated into existing cleaning roller apparatus.

The present invention also includes a powered drive means for rotating the support carrying the lint roll for ease in effecting cleaning operation as well as simplifying the removal of a dirty outermost sheet from the roll.

BRIEF DESCRIPTION OF THE DRAWING

The various features, advantages and other uses of the present invention will become more apparent by referring to the following detailed description and drawing in which.

DETAILED DESCRIPTION

Figure 1:
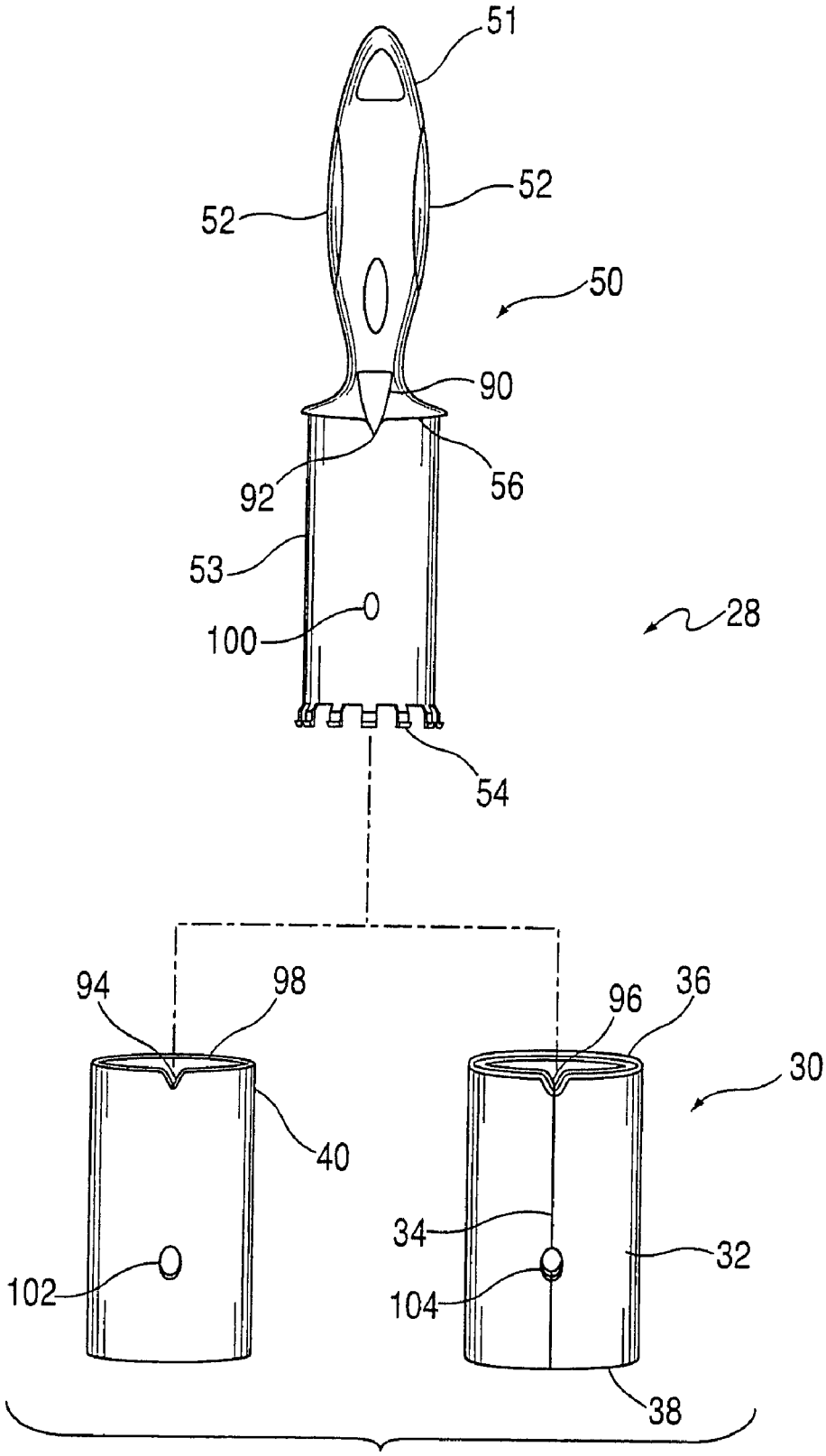
FIG. 1 is a exploded, perspective view of one aspect of a lint roller apparatus with orienting capability according to the present invention.

Referring now to FIG. 1, there is depicted a tape roll 30 for a lint removal apparatus 28 according to the present invention. The tape 32 wound into a roll form The tape is preferably formed of at least two material layers, one constituting a substrate or backing layer and the other constituting an adhesive layer, both having opposed side edges 36 and 38 and opposed, major, first and second surfaces.

The substrate is formed of a suitable material, such as silicone coated flat backed paper or crepe paper or plastic film. Any, suitable paper and plastic films, known in the relevant industry, may be employed. The substrate can be opaque, transparent, colored or have printed indicia thereon as well as being formed with different surface textures or embossments.

The adhesive layer is disposed on or applied to substantially all or one major surface of the substrate. The adhesive layer can be applied to the substantially all of one major surface of the substrate between the side edges 36 and 38.

Suitable adhesives which form a tacky, partially pressure sensitive surface for picking up lint and debris from other surfaces as generally known in the relevant industry may be employed. Typically, such adhesives are known as "pressure sensitive" adhesives and are normally tacky at room temperature. Such adhesives can be adhered to a surface by the application of light pressure.

Further details concerning the types of materials which can be used to form the substrate and the adhesive layer may be found by referring to U.S. Pat. No. 5,027,465, the relevant portions of which pertaining to the substrate and adhesive materials are incorporated herein by reference.

As shown in FIG. 1, the tape is wound into a continuous roll 30 about a core or in a coreless fashion. An interior bore is formed in the roll 30 for the core, if used, and/or for receiving a rotatable handle element as described hereafter.

A separable edge 34 is formed substantially through the roll 30 at one location between the side edges 36 and 38. The separable edge 34 divides the tape into a series of end to end arranged sheets 32. As described hereafter, the outermost sheet 32 may be removed from the roll 30 after it is soiled thereby to enable a new clean sheet to replace the soiled and removed outer sheet on the exterior surface of the roll 30.

As shown in FIG. 1, the lint roller/brush assembly 50 includes a one-piece body which can be formed of a blow molded plastic. The body includes a handle 51 which may contain resilient inserts 52 as described above.

The handle 51 integrally transitions into a tape roll support section 53 which has an inner elongated generally cylindrical portion for supporting the tape roll 30. One end of the support section 53 is formed with a plurality of radially outward extending fingers or projections 54. The fingers 54 are bendable or expand the roll 30 upon insertion of a tape roll 30 thereover to enable the tape roll 30 to be slid over the support section 53 into engagement with a shoulder 56. The fingers 54 trap the tape roll 30 on the support section 53.

The lint apparatus 28 shown in FIG. 1 utilizes a manual orienting means for aligning the edge 34 of all the sheets 32 in the roll 30 at a predetermined angular position about the roll support 53. The orienting means includes a pawl or projection 90 which may have an arrowhead or pointed shape. The pawl 90 is mounted on or formed on the handle 51 and has an end 92 projecting over the shoulder 56 of the handle 51. The end 92 of the pawl 90 is adapted to engage a complementary shaped recess 94 in a core 40 of a lint roll or a recess or notch 96 in the side edges of all the sheets 32 in the roll 30 during each 360° rotation of the roll 30 with respect to the handle 51. The notch 94 in the core 40 or the notch 96 in the tape roll 30 is aligned with the edge 34 of the sheets 32 as shown in FIG. 1.

Alternately, the pawl or pin 90 can be spring-loaded on the handle 51. Further, the pawl 90, either fixed or spring-loaded, can be carried on a core or carrier of the roll 30 which is releasably engagable with a notch formed in the handle 51.

During cleaning operations, contact force will cause the roll 30 to rotate about the support 53. During such rotation, the end 92 of the pawl 90 rides along the end 36 of the roll 32 or along an end 98 of the core 40 until the end 92 of the pawl 90 re-engages the notch 94 or 96 to lock the roll 30 or the core 40 in the oriented position with the end 92 of the pawl 90 pointing directly along the edge 34 of the new outermost clean sheet on the roll 30.

FIG. 1 also depicts an alternate orienting means which may be used by itself or in combination with the pawl 90 and notches 94 or 96. This orienting means includes a projection 100 formed on the roll support 53 at a position aligned with the pawl 90 or extending along the longitudinal axis of the handle 51 as defined by a point centrally located between the opposed resilient pads 52. A mating aperture 102 is formed in the core 40 or a mating aperture 140 is formed through all or at least the innermost sheets of the sheets 32 in the roll 30 at a position along the width of the edges 34 of each of the sheets 32. During rotation of the roll 30 or rotation of the core 40 about the support 53, free rotation is possible until the projection 100 engages the aperture 104 in the core 40 or the aperture 104 in the coreless roll 30 thereby stopping further rotation and aligning the edge 34 of the outermost sheet 32 with the pawl 90.

Figure 2:
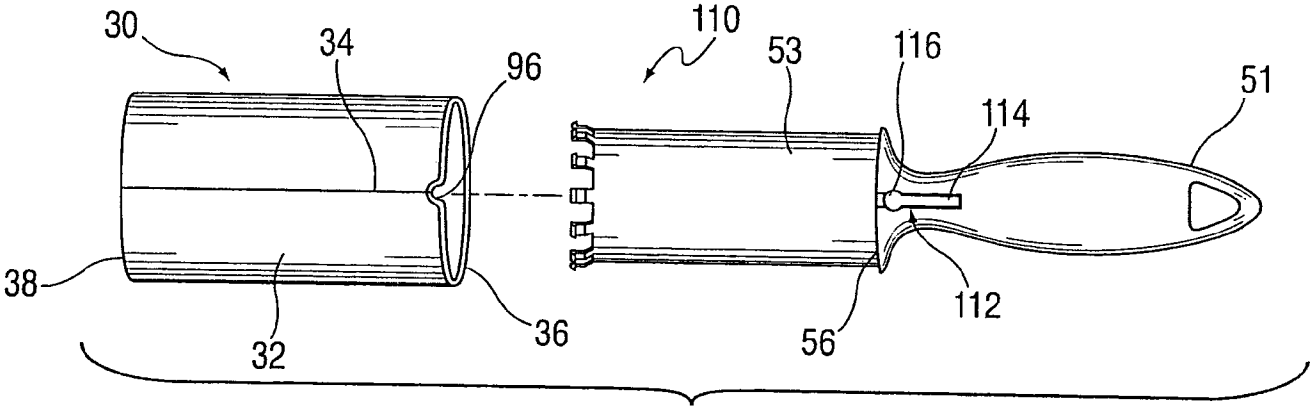
FIG. 2 is an exploded, side elevational view of another aspect of a lint roller apparatus with orienting capability according to the present invention.
Figure 3:
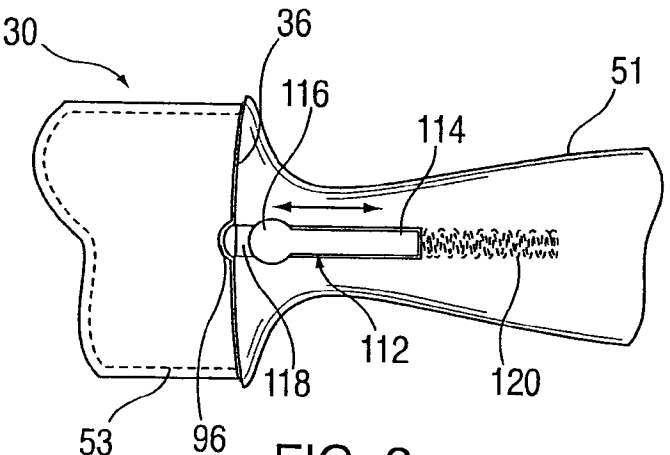
FIG. 3 is an enlarged, partial perspective view of the slide shown in FIG. 2.

Another aspect of an orienting means is shown in FIGS. 2 and 3. In this aspect, the lint roll 110 is substantially the same as the lint roll shown in FIG. 1 and is capable of receiving a coreless lint roll 30 with an edge indentation 96 or a lint roll mounted about a core, such as core 40 with edge indentation 96 as shown in FIG. 1. The lint roll 30 is mounted over the support 53 so as to position the indentations 94 or 96 adjacent to the edge 56 of the handle 51.

The orienting means includes a slide member 112 having a finger engaging end 114 and a notch engaging end 116. The notch engaging end 116 is shaped complementary to the shape of the indentations 94 or 96. The slide member 112 is mounted at least partially in a slot 118 in the handle 51. An optional return spring 120 may be mounted within the handle 51 and fixed at one end to the handle 51 and at another end to the slide member 112. The biasing member means or spring 120 functions to return the slide member 112 to a first position shown in FIG. 3, wherein the notch engaging end 116 is spaced from the notches 96 or 94 in the lint roll 30.

When the user decides that the outermost sheet 30 to a lint roll 30 needs to be removed, the user grasps the edge 32 and exerts a pulling force perpendicular to the axis of the handle 51. At the same time, the user engages a finger with the finger engaging end 114 of the slide member 112 and exerts a force on the slide member 112 in a direction to move the slide member 112 from the first position shown in FIG. 3 to the second position which the end 116 extends over the edge of the handle 51 into contact with the end 36 of the tape roll 30. Rotation of the tape roll 30 will continue until the end 116 engages the notch 96 in the tape roll 30 stopping further rotation and orienting the edge 34 with the slide member 112. The user can then separate the outermost sheet 32 by tearing the trailing edge sheet perforations along the edge 34.

Also, the user can move the slide member 112 forward while the roll 30 is still rotating under centrifugal force from the last cleaning movement to let the end 116 find and engage the notch 96.

Figure 4:
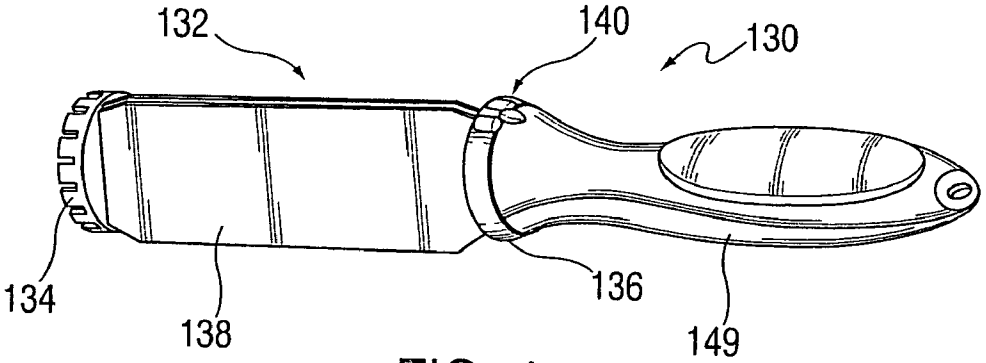
FIG. 4 is a perspective view of another aspect of a lint roller apparatus with orienting capability according to the present invention.
Figure 5:
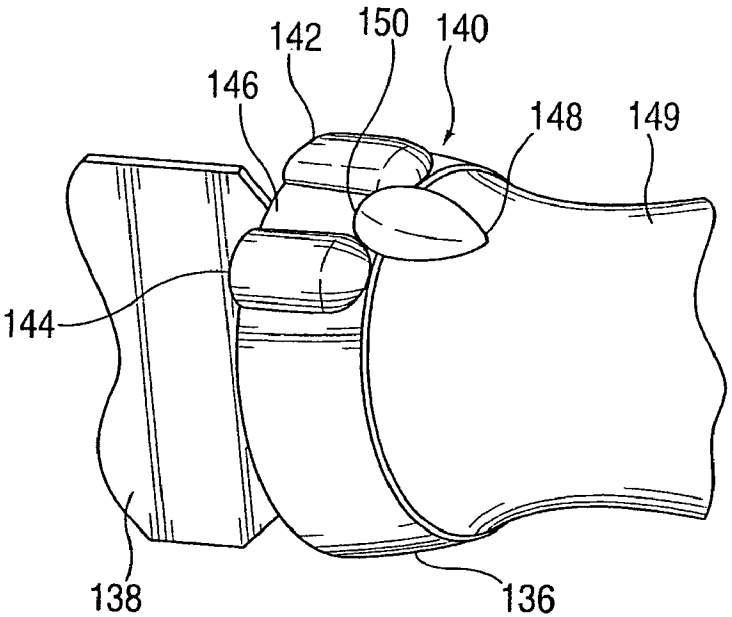
FIG. 5 is a partial, enlarged perspective view of the orienting detent shown in FIG. 4.

Another manually operated orienting means for a lint roller 130 is shown in FIGS. 4 and 5. The lint roller 130 is formed substantially the same as the lint rollers 50 and 110 with the exception that instead of a lint roll support fixed and contiguous with the handle, the lint roller apparatus 130 includes a rotatable spindle 132, such as that described in U.S. Pat. No.

4,361,973. The spindle 132 includes a pair of opposed, spaced collars 134 and 136 which engage and define the mounting position of a lint roll 30, not shown, on the spindle 132. Rotatably located between the collars 134 and 136 is a carriage formed of a plurality of straps 138. The collars 134 and 136 and the straps 138 rotate about through a central spindle 132.

An orienting means 140 includes a pair of spaced stop members 142 and 144 fixedly carried on the collar 136 and moveable with rotation of the collar 136 and the spindle 132. The stop members 142 and 144 define a channel 146 therebetween which is aligned with and which defines the orienting or registration position of the free end 34 of the lint roll 30. A latch member 148, such as a projection, is carried on the handle 149 and overlays the edge of the handle 149 so that an end portion 150 is releasably engagable in the channel 146 between the stop members 142 and 144. At least the exterior surfaces of the stop members 142 and 144 and the latch member 148 which are brought into and out of engagement with each other are rounded for smooth engagement and disengagement. Further, the apparatus 130 can be formed of a soft plastic, such as polypropylene, polyethylene or an elastomeric material, for example, to facilitate smooth interaction of the projection 148 with the stop members 142 and 144.

In use, force exerted by the user on the lint roll to rotate the lint roll about the centrally located spindle 132 will be sufficient to snap the latch member 148 out of engagement with the stop members 142 and 144 allowing free 360° rotation of the spindle 142 one or more complete revolutions about the spindle. When completing the cleaning operation, the user can continue to engage the lint roll 30 with the surface to enable the latch member 148 to snap into the channel 146 between the stop members 142 and 144 releasably blocking further rotation of the lint roll 30 and aligning the edge 134 of the lint roll 30 with the latch member 148, or the user can let the centrifugal force of the rotating roll 30 drive the stop members 142 and 144 into engagement with the projection 148.

Figure 6:
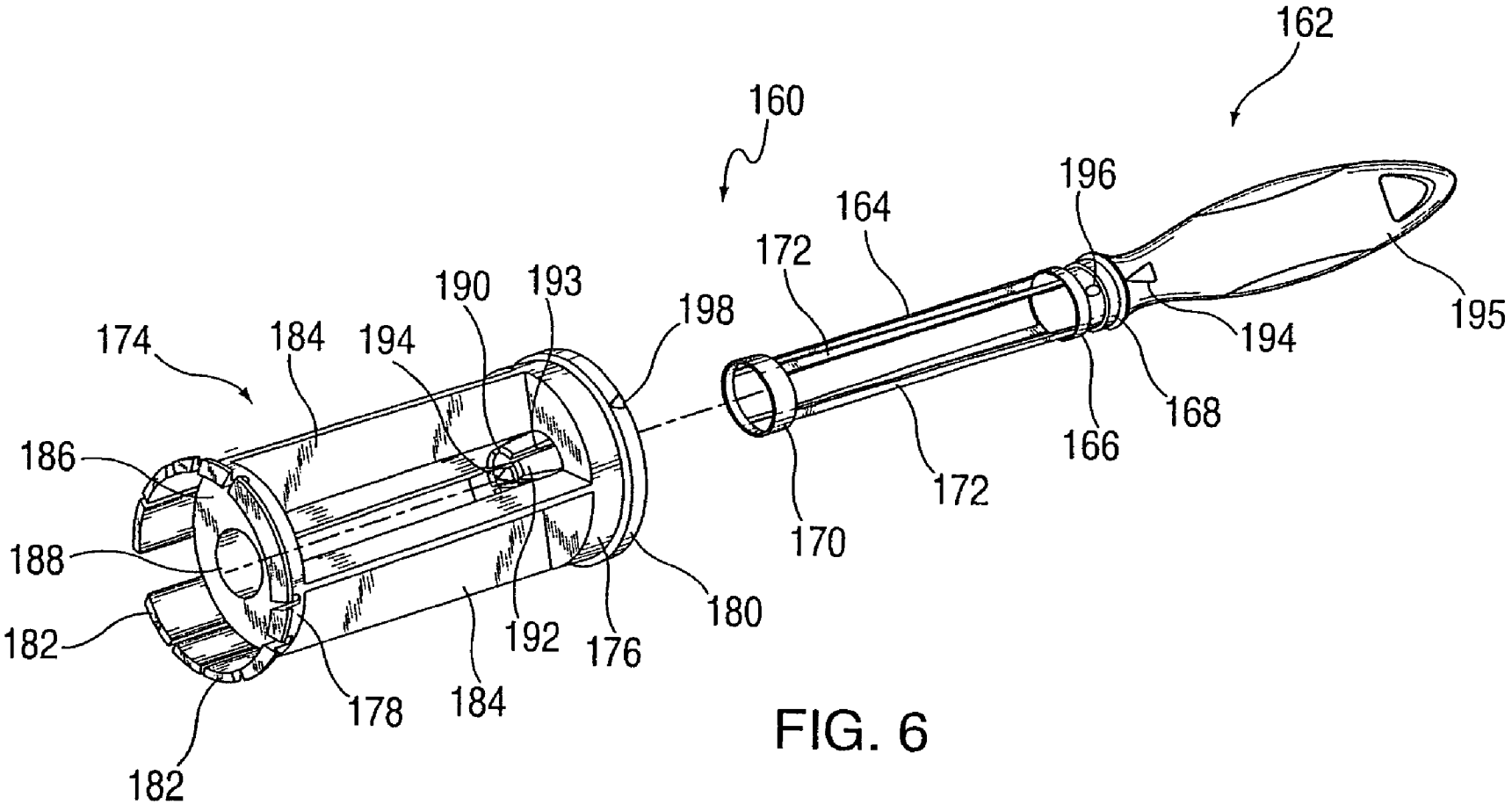
FIG. 6 is an exploded, perspective view of another aspect of a lint roller apparatus with orienting capability according to the present invention.
Figure 7:
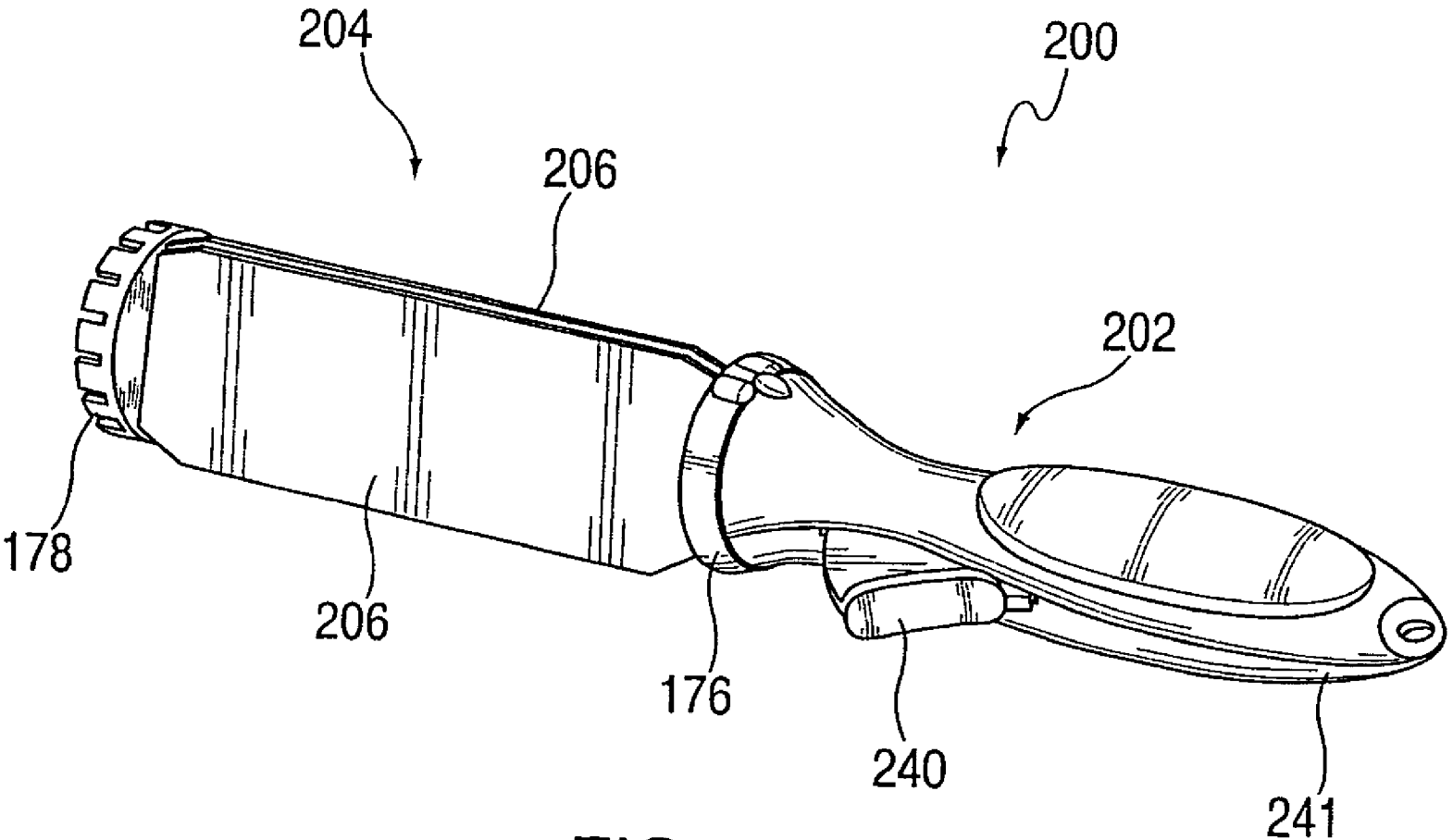
FIG. 7 is a perspective view of another aspect of a lint roller apparatus with orienting capability according to the present invention.

In the lint roller apparatus 160 shown in FIG. 6, a handle 162, substantially the same as the handle as shown in the prior aspects of the invention has a roller cylinder support shaft 164 projecting from one end. The shaft 164 has a pair of raised, annular flanges 166 and 168 which are spaced apart and disposed adjacent to one end of the handle 162. The flanges 166 and 168 define a slot therebetween, the purpose of which will be described hereafter. The opposite end of the shaft 164 terminates in an annular sleeve 170. At least one and preferably a plurality of circumferentially spaced ribs 172 extend along the exterior of the roller support 164 between the flange 166 and the sleeve 170.

A roller support cylinder 174 is defined by a pair of axially spaced, annular collars 176 and 178. The collar 176 has a raised annular flange 180 extending radially outward from one end. The opposite collar 178 has a plurality of circumferentially spaced fingers 182 extending therefrom and terminating in a radially outward extending end 184 which define lock means for supporting a lint roll 30, not shown, on the cylinder 174. A plurality of straps 184 extend between the collars 176 and 180 to define a substantially cylindrical shape for the roller support 174.

An end cap 186 is formed in the collar 178 and has a central aperture 188 sized to receive the sleeve 170 on the support 164. An interior end cap 190 extends axially from one side of the sleeve 170 and one side of the collar 176 and has a plurality of generally tapered fingers 192 which define a central aperture 194 therebetween for receiving the ribs 172 on the roller spindle 164.

When the roller cylinder 174 is mounted over the spindle 164, the sleeve 170 will engage the end cap 188. The fingers 192 surround the spindle 164 to permit free rotation of the cylinder 174 on the spindle 164.

The orienting means in this aspect of the invention includes an orienting indicia, such as an arrow 194 formed or imprinted on one end of a handle 195 and pointing to the oriented direction of the end of the lint roll 30 supported on the cylinder 174. The arrow 194 could also be on the cylinder 174. A projection 196 may be formed on the spindle 164 at any one of a number of positions, such as in the channel between the flanges 166 and 168, for example. The projection 196 is disposed underneath the lock fingers 192 when the cylinder 174 is mounted over the spindle 164 and alternatingly lockingly engage each slot between the lock fingers 192 as the cylinder 174 rotates about the spindle 164 which can produce an audible click. The cylinder 174 can be rotated until the projection 196 engages one of the slots 193 between the lock fingers 192 and the orienting indicia 194 on the handle is aligned with a similar orienting indicia 198 on the cylinder 174 to indicate that the edge 34 of the outer sheet 32 of the lint roll 30 is aligned with the selected orientation direction.

Another aspect of the lint roller apparatus 200 of the present invention is shown in FIGS. 7-11. The lint roller apparatus 200 includes a handle 202 substantially the same as the handles in the previous aspects of the of the present invention.

An opposite arrangement is also possible where the projection is on the spindle and the notch is on the cylinder or rotating member. The handle 202 may be blow molded in one piece or formed as multiple joined pieces.

Likewise, a rotatable spindle 204 is substantially the same as the spindle 164 and cylinder 174 described in conjunction with FIG. 6 except that the plurality of circumferentially spaced, radial straps 184 are replaced by a pair of parallel extending straps 206 which extend between collars 176 and 178. Otherwise, the cylinder 204 functions in the same manner as the cylinder 174 in supporting a lint roll, not shown.

The cylinder could also be forced as two collars on a central axle which is fixed to the drive shaft.

Figure 8:
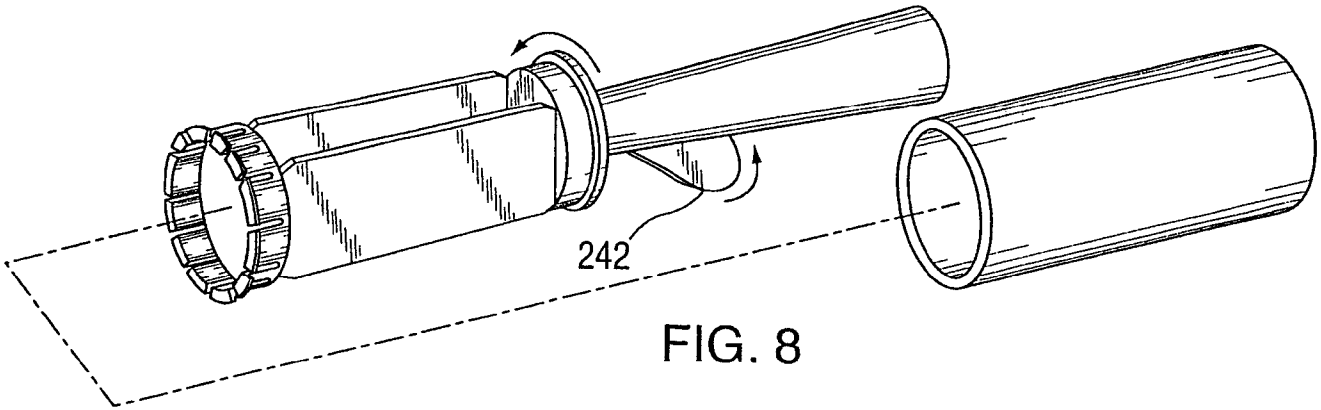
FIG. 8 is an exploded, perspective view of another aspect of a lint roller apparatus with orienting capability according to the present invention.
Figure 9:
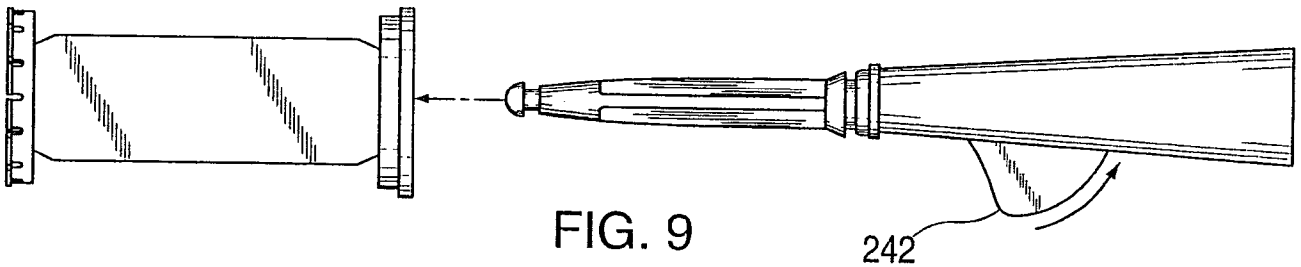
FIG. 9 is an exploded, side-elevational view of the lint roller apparatus shown in FIG. 8.
Figure 10:
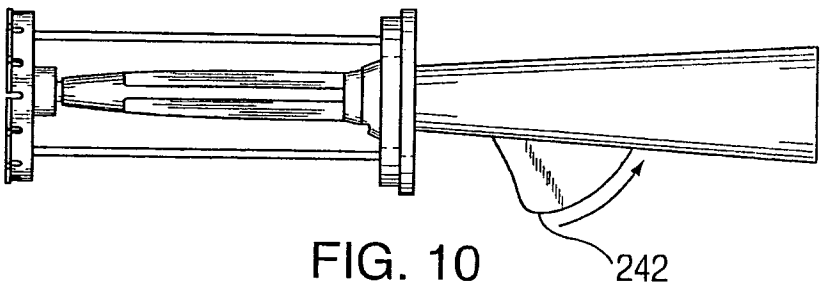
FIG. 10 is a side-elevational view of an assembled lint roller apparatus shown in FIGS. 8 and 9.

In this aspect of the invention, the orienting means includes a trigger 240 which may take any of a number of different shapes. The trigger 240 is pivotally mounted on an exterior side of the handle 241 and is depressable from a first, outwardly extending, rest position shown in FIG. 7 to a depressed position as described hereafter. In FIGS. 8-10, the trigger 242 is shown with a different shape and pivotal direction. However, the function of the trigger 242 is the same as the trigger 240.

Figure 11:
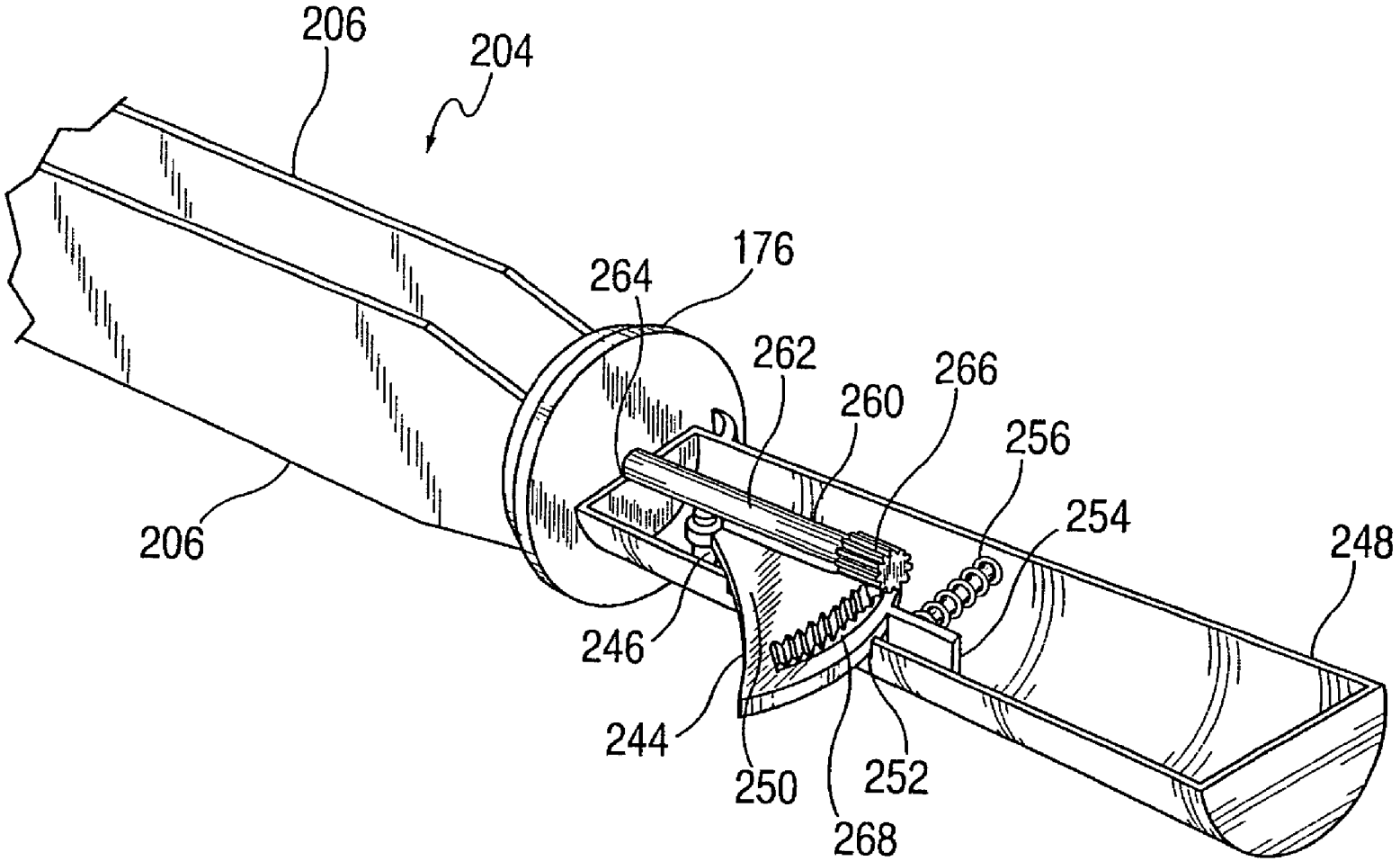
FIG. 11 is a partially broken away, perspective view of another aspect of a lint roller apparatus with orienting capability according to the present invention.

In FIG. 11, a slightly different shaped trigger 244 is pivotally mounted to a boss 246 disposed within the interior of a handle 248. The trigger 244 is in the form of a planar member 250 which pivotally extends through an aperture or slot 252 in the handle 248. An arm 254 is fixed to and extends outward from one edge of the member 250 and engages a return means, such as a spring 256 fixed at one end to the handle 248 and at another end to the arm 254, for automatically returning the trigger member 250 to the first position shown in FIG. 11 after activating pressure is moved the trigger member 250 to a second position.

A spindle rotating means 260 is coupled between the trigger 244 and the collar 176 of the roller cylinder 204. The rotating means 260 includes an axle 262 extending integrally from collar 176 through a boss 264 on the handle 248.

The other end of the axle 262 carries a spur gear 266 which rotatably engages a sector gear 268 carried on the trigger member 250. It can be seen from FIG. 11, depression of the trigger member 250 from the first position inward toward the handle 248 to the second position causes the sector gear 268 to move along and rotate the spur gear 266. This results in simultaneous rotation of the collar 176 and the remainder of the cylinder 204 to rotate the lint roller mounted on the cylinder 204 one full 360° rotation or increment of 360°. For example, the amount of rotation created by each full depression of the trigger member 250 might be 180° thereby requiring two trigger movements. In this case, a ratchet-like connection would be incorporated into the trigger to prevent back rotation of the cylinder 204 or release of the trigger member 250. This rotation insures that the free end 34 the lint roll 30 remains aligned with a twelve o'clock position on the exterior of the handle 248 which is defined as the selected oriented position.

Figure 12:
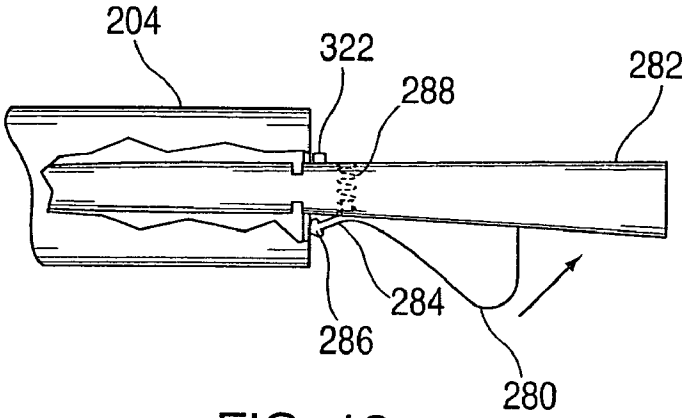
FIG. 12 is a side-elevational view of another aspect of a lint roller apparatus with orienting capability according to the present invention.
Figure 16:
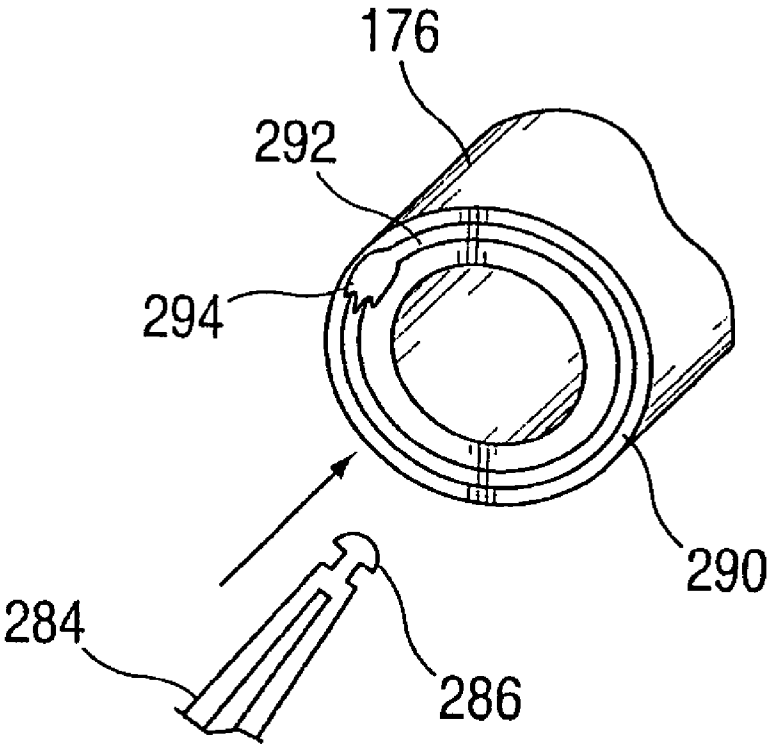
FIGS. 15 and 16 illustrate different aspects of a stop means carried on the tape roll which is engagable with the trigger actuated pins shown in FIGS. 12, 13 and 14.
Figure 15:
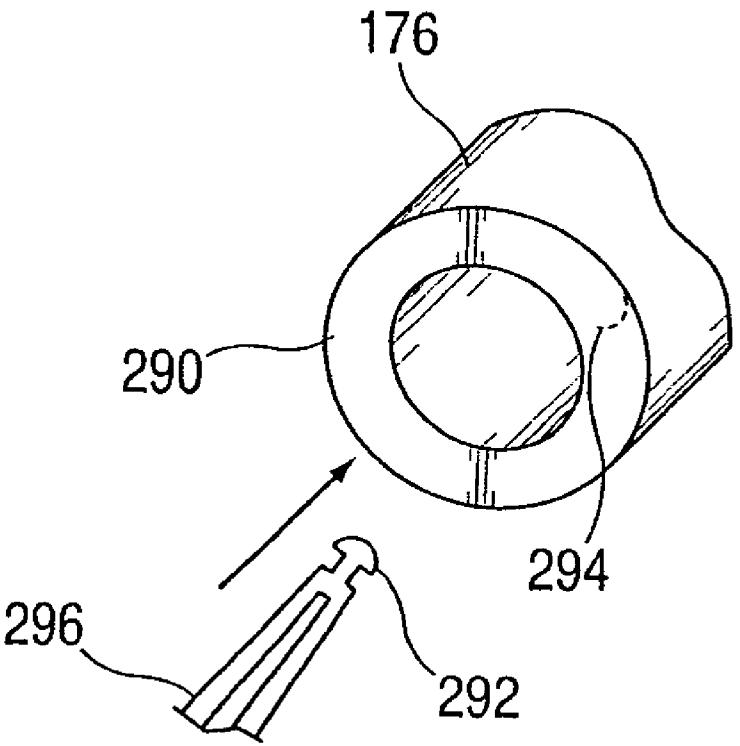

Referring now to FIGS. 12-16, there are depicted alternate aspects of a trigger or slide orienting latch which can be used to stop rotation of the spindle to orient the free edge 34 of the lint roll 30 in the desired oriented position. In FIGS. 12 and 16, trigger member 280 supported on handle 282 has a pin 284 extending from one end. The pin 284 terminates in an enlarged head 286. The return spring 288 may be provided in the handle 282 to return the trigger 280 to the first, non-pressure applied position shown in FIG. 12.

The head 286 of the pin 284 is shown in FIG. 16 as being disposed in close proximity to an end 290 of the collar 176 on the spindle 204. An annular track or recess 292 is formed in the end 290 of the collar 176. An enlargement 294 is formed in the track 292.

It will be seen that when the trigger 280 is not depressed, the head 286 of the pin 284 merely slides along the track 292 with little resistance to rotation of the spindle 204. However, when the trigger 280 is depressed, the pin 284 pivots bringing the head 286 in a direction under force to one side of the track 292 until rotation of the spindle 204 causes the head 286 of the pin 284 can slide into the enlargement 294 thereby stopping further rotation of the collar 176 and the entire spindle 204 and lint roll 30. Release of the trigger 280 will again allow free rotation of the lint roll 30.

Figure 13:
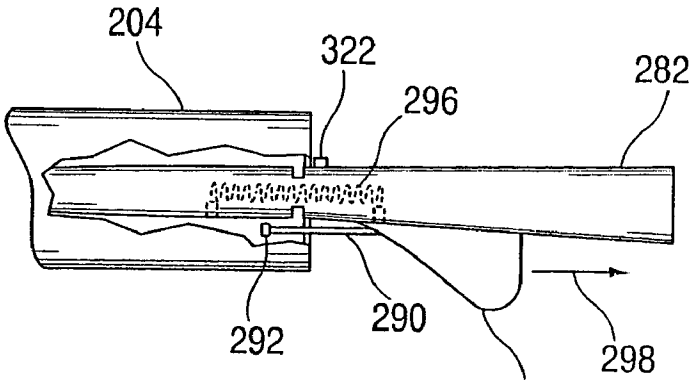
FIG. 13 is a side-elevational view of another aspect of a lint roller apparatus with orienting capability according to the present invention.

In FIG. 13, a trigger 289 has a pin 290 projecting therefrom. The pin 290 terminates in an enlarged head 292 which is capable of engaging a stop 294 shown in FIG. 15 on one end 290 of the collar 176. The trigger 289 in FIG. 13 is designed more as a slide and is moveable from a first unpressured position shown in FIG. 13 to which it is automatically returned by biasing means 296, such as a spring mounted within the handle 282, to a second, forward, position in the direction of arrow 298 separating the head 292 of the pin 290 from the stop 294 and allowing free rotation of the spindle and lint roll relative to the handle 282.

Figure 14:
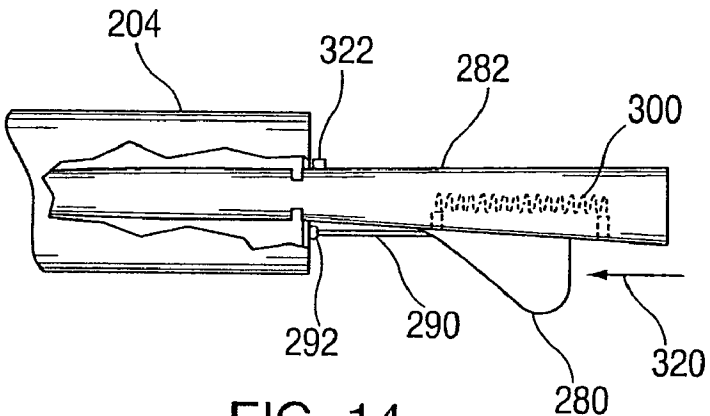
FIG. 14 is a side-elevational view of another aspect of a lint roller apparatus with orienting capability according to the present invention.

The orienting means shown in FIG. 14 is similar except that the biasing means 300 mounted within the handle 282 acts to position the trigger 280 in a normal, unpressured position wherein the head 292 of the pin 290 is spaced from the end of the collar 176 of the spindle 204. A sliding movement in the direction of arrow 320 will force the head 292 of the pin 290 into engagement with the stop 294 when the spindle rotates to a position bringing the stop 294 to the head 292 of the pin 290 thereby stopping further rotation of the spindle 204 and orienting the end of the lint roll with an orienting indicia 322 on the handle 282.

Figure 17:
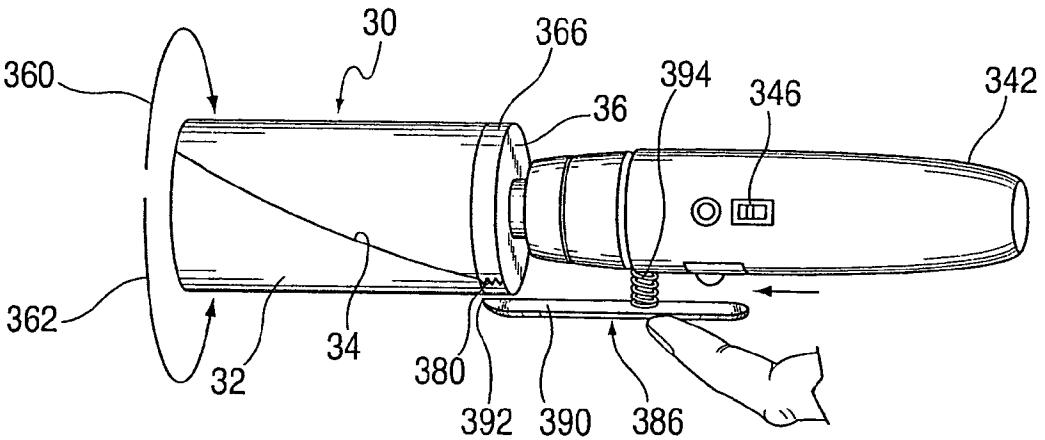
FIG. 17 a side elevational view of another aspect of a lint roller apparatus according to the present invention.
Figure 18:
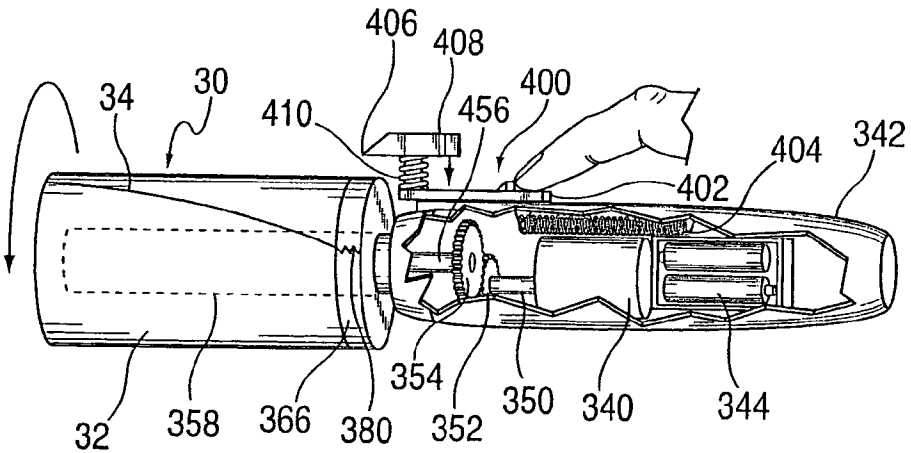
FIG. 18 is a partially broken away, perspective view of another aspect of a lint roller apparatus according to the present invention.

Refer now to FIGS. 17 and 18, there is depicted a housing 342 with a handle shaped end. A motor 340 is mounted in the housing 342 and selectively connected to a power source, such as one or more batteries 344 contained within the housing 342, by an on/off switch 346 in FIG. 17 or by contacts 348 engaged by a connector member 350 in FIG. 18, to activate the motor 340 and cause rotation of the motor output shaft 350 in one direction. The output shaft 350 carries a first gear 352 which selectively engages a second gear 354 mounted on an axle 356 connected to or integrally formed as part of a shaft 358 on which the lint roll 30 is mounted. In this manner, rotation of the motor output shaft 350 is transmitted by the meshing gears 252 and 254 to rotation of the axle 356 and the shaft 358 resulting in rotation of the lint roll 350.

In the aspect of the invention shown in FIG. 17, the on/off switch 346 may be a three-position switch containing "off", "forward" and "reverse" positions thereby enabling the motor 340 to rotate the lint roll 30 in either of two directions 360 and 362 as shown by the arrows in FIG. 17.

In both FIGS. 17 and 18, the lint roll 30 is provided with a non-adhesive or so-called dry edge 366 adjacent the side end 36 of the lint roll 30. The dry edge 366 facilitates separation of the outermost sheet 32 of the lint roll 30 when it is desired to replace a dirty outermost sheet with a clean underlying sheet. A perforation or tear strip 380 may be formed on the dry edge 366 of each sheet 32.

According to a unique aspect of the invention, a sheet separator means 386 in FIG. 17 is provided for separating the edge 34 and the tear strip 380 from the roll 340 to facilitate removal of the outermost sheet. In the aspect of the invention, the separating means in the form of a blade 390 having a pointed or knife edge 392 or other separating element, such as bristles or an elastomeric, plastic, or metal member, which overlays the dry edge 366 of the lint roll 30. The biasing means 394 mounted on the housing 342 normally biases the blade 390 in a direction to separate the knife edge 392 from the dry edge 380 on the lint roller 30. However, finger pressure can overcome the force of the biasing spring 394 bringing the knife edge 392 to an engagement with the dry edge 380. Simultaneous activation of the motor 340 resulting in rotation of the lint roll 30 will cause the knife edge 392 to pierce and separate the tear strip 380 on the dry edge 366 and allow separation of the outermost sheet 32 from the remainder of the lint roll along the edge 34. The user will normally deactivate the motor 340 or release the finger pressure on the member 390 when the outermost sheet 32 has been completely removed from the lint roll 30 and/or the next edge is properly oriented, either visually, or by an orienting means, such as those described above.

In the aspect of the invention shown in FIG. 18, the separator means 400 is in the form of a slide member 402 slidably mounted on the exterior of the handle 342 and normally biased by a spring 404 contained within the housing 342 to a forced normal position spaced from the lint roll 30. However, finger pressure can move the slide member 402 to an engaged position shown in FIG. 18 wherein a knife edge 406 on a blade 408 is brought into engagement with the tear strip 380 on the dry edge 366 of the lint roll 30 separating the tear edge 380 and the remainder of the free end 34 of the outermost sheet 32 from the remainder of the lint roll 30 simultaneous with rotation of lint roll 30 through activation of the motor 340.

A pair of contacts 348 carried on the housing 342 are bridged by the connector 340 when the slide member 402 reaches the forward position to connect electric power from the batteries 344 to the motor 340. A biasing means 410 may be coupled between the housing 342 and the blade 408 to normally bias the member 408 in a direction to bring the knife edge 406 into engagement with the dry edge 366 on the lint roll 30. In this manner, continually decreasing diameter of the lint roll 30 which occurs through repeated removal of the outermost sheets of the lint roll 30 is accommodated.

Figure 19:
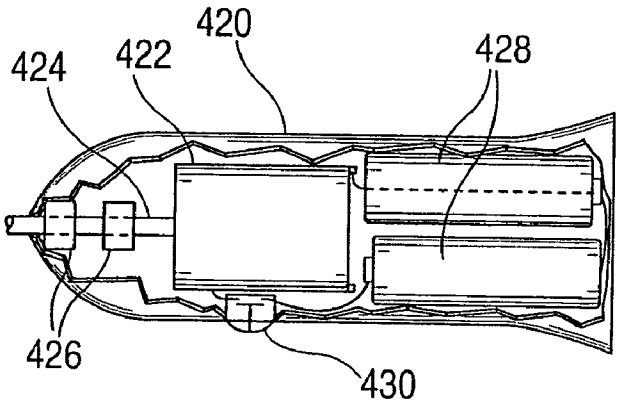
FIG. 19 is a side elevational, pictorial representation of another aspect of a lint roller apparatus according to the present invention.

Referring now to FIG. 19, there is shown a pictorial representation of another aspect of a powered drive means mounted in a housing 420 for, when activated, rotating the spindle 356. In FIG. 19, a drive means 422, such as a DC electric motor is mounted in the housing 420. The output shaft 424 of the motor 422 extends through supports or bearings 426 to an end coupled, integrally or mechanically to the rotatable spindle. A power source, such as storage batteries 428 is contained within the housing 420 and electrically connected to the motor 422 to drive the motor 422 by an on/off switch 430 mounted on the housing 420.

Figure 20:
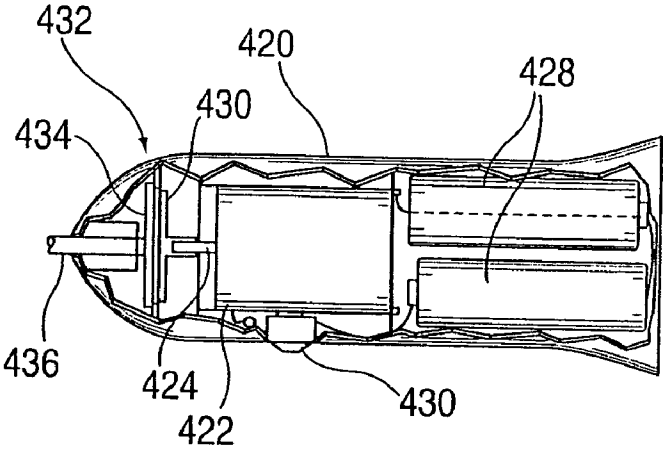
FIG. 20. is a side elevational, pictorial representation of another aspect of the lint roller apparatus according to the present invention.

The drive means shown in FIG. 20 is similar to that of FIG. 19 with similar components depicted by the same reference number.

In this aspect, however, the output shaft 424 of the motor 422 is coupled to one plate 430 of a clutch means 432. The other plate 434 of the clutch 432 is coupled to a shaft 436 which extends to a connection with the rotatable spindle. The clutch 432 allows slip between the plates 430 and 434 if resistance is met during rotation of the shaft 432.

Figure 22:
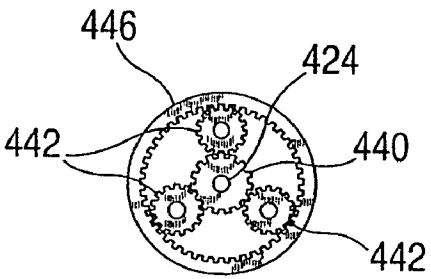
FIG. 22 is a view in the direction of arrows line 22-22 in FIG. 21.
Figure 21:
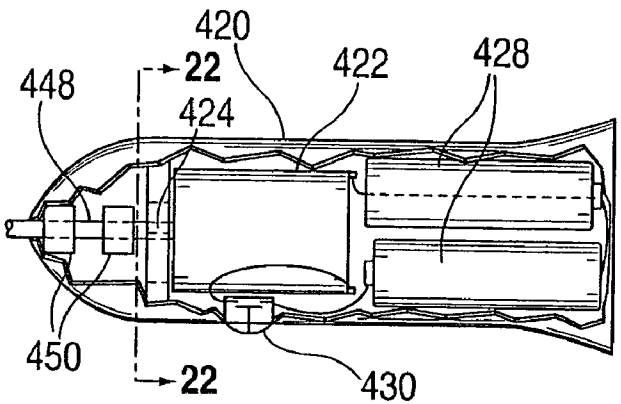
FIG. 21 is a side elevational, pictorial representation of yet another aspect of the lint roller apparatus according to the present invention.

In the apparatus shown in FIGS. 21 and 22, the output shaft 424 of the motor 422 is joined to a central gear 440. A plurality of planetary gears 442 surround and engage the sun gear 440. The planetary gears 442 are in turn coupled to an external ring gear 446. A drive shaft 448 is coupled to the ring gear 442 and supported in bearings 450. The drive shaft 448 is coupled to the rotatable spindle.

Figure 23:
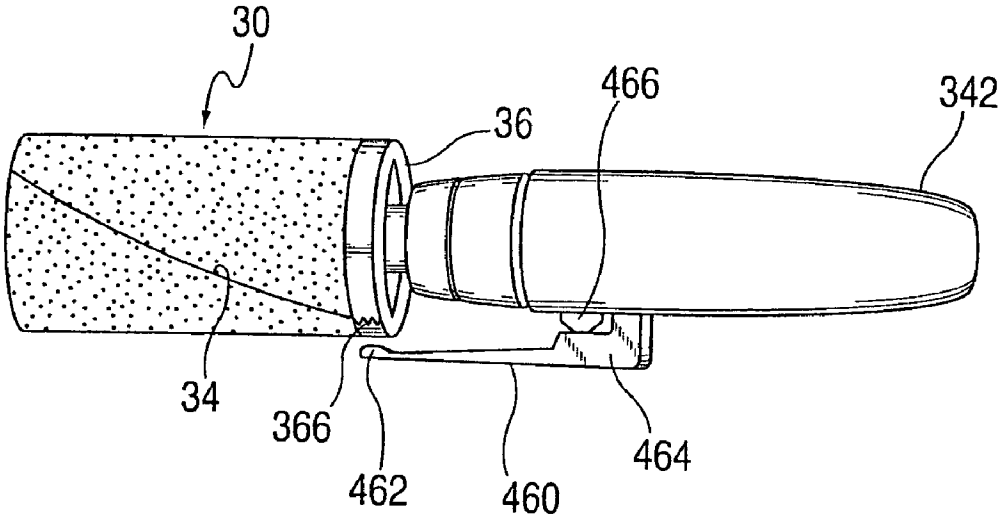
FIG. 23 is a side perspective view of yet another aspect of the lint roller apparatus according to the present invention.

Referring now to FIG. 23, there is depicted a modification to the blade member shown in FIG. 17. In this aspect of the invention, the blade member 460 has an end 462 freely cantilevered from an opposite end affixed to the housing 342. The free end 462 is formed as a knife edge for engaging and separating the tear strip 366 on the lint roll 30 after the motor has been activated to rotate the lint roll 30. A bendable portion 464 of the blade 460 overlays and on/off switch 466 coupled, as shown in FIGS. 19, 20 and 21 to connect electrical power from an on board storage source contained within the housing 342 to the motor, also contained within the housing 342.

Figure 24:
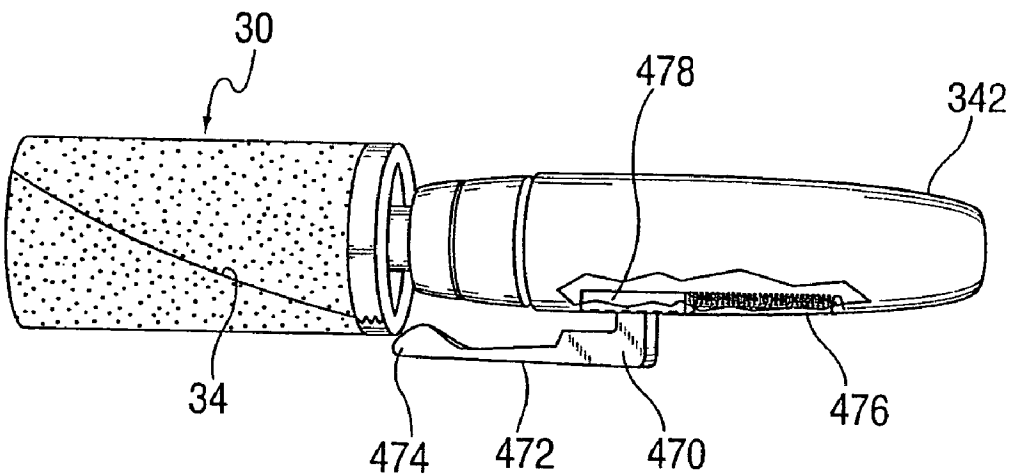
FIG. 24 is a side perspective view of yet another aspect of the lint roller apparatus according to the present invention.

The aspect of the invention shown in FIG. 24 is similar to that of FIG. 23 except that the blade member 470, also having a cantilevered end 472 terminating in a knife edge 474 is slidably mounted on the housing 342. Movement of the blade member 342, from a first position to which it is automatically returned upon the release of pressure by a return spring 476 mounted within the housing 342, activates a switch 478, also contained within the housing, at a forward sliding position. The switch 472 is connected to electrically supply power from the batteries to the motor, as described above.

Figure 25:
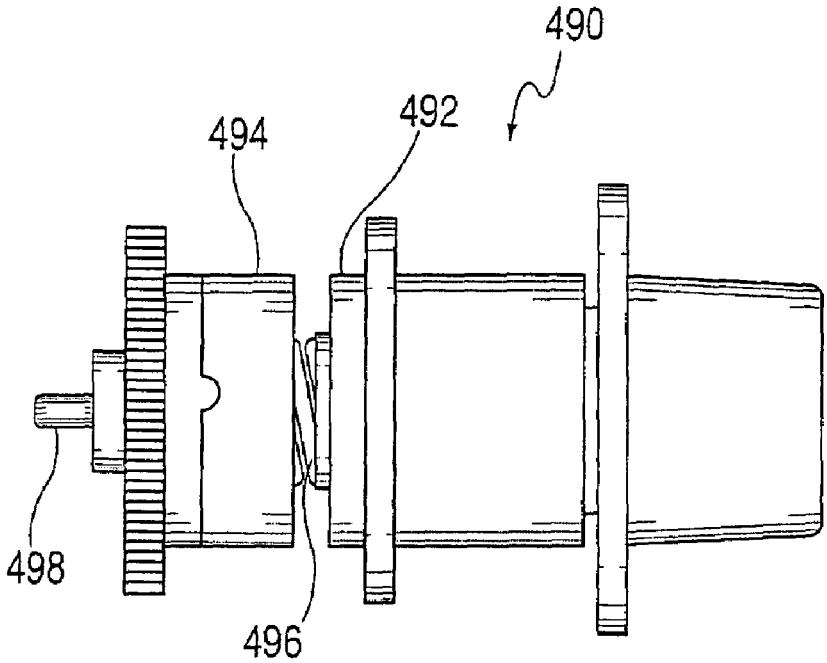
FIG. 25 is a side elevational view of a power transmission means employable in any of the apparatus shown in FIGS. 17-24.

In FIG. 25, an alternate clutch mechanism 490 is illustrated. The clutch mechanism 490 is designed to be used with any of the power drive means, and mounted within a housing 342. An output shaft of the drive motor, such as drive motor 340 in FIG. 18, is coupled to a first clutch plate 492. A second clutch plate 496, moveably spaced from the first clutch plate 492 carries a drive shaft 498 which can be coupled to or integrally formed with a spindle on which the lint roll is mounted.

A compliant means 496 is disposed between the first and second clutch plates 492 and 496. The compliant means 496 may comprise a spring which is unwindable from a first, tightly wound position bringing the first and second clutch plates 492 and 494 into engagement for transmission of drive power from the motor to the drive shaft 498 and a second position in which the compliant means expands to separate the second clutch plate 494 from the first clutch plate 492. Such expansion of the compliant means 496 would occur, for example, if an obstruction, such as an orienting pin, is encountered by the lint roll 30 which substantially hinders or stops rotation while the drive motor is still trying to apply power through the clutch means 490 to the drive shaft 498. In this occurence, the compliant means 496 expands separating the clutch plates 492 and 494 and disrupting power to the drive shaft 498.

Upon removal of the obstruction, the compliant means 496 can rewind to a first position bringing the second clutch plate 494 back into engagement with the first clutch plate 492.

FIGS. 26-30 depict alternate cleaning elements which can be mounted directly onto any of the rotatable spindles, described above, in place of the lint roll 30.

Figure 26:
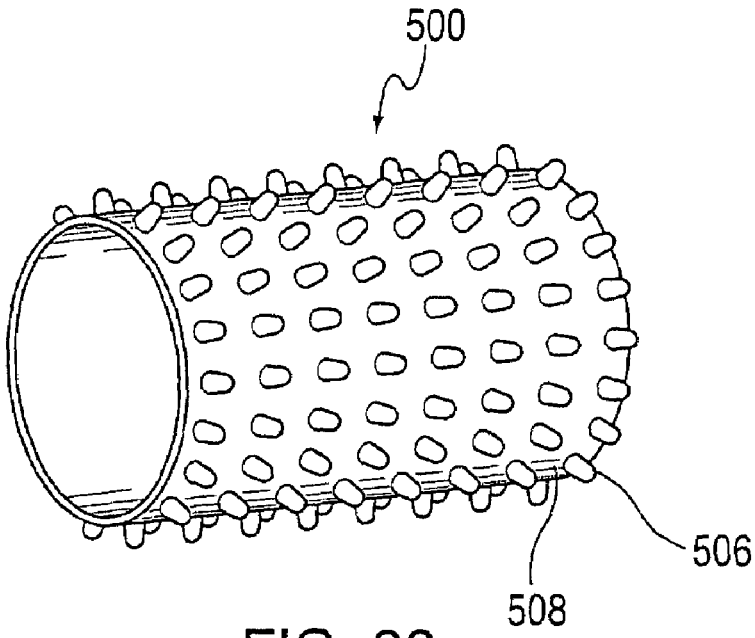
FIGS. 26-28 are perspective views of alternate aspects of a cleaning element which is mountable on the rotatable cylinder of various aspects of the present invention.

The cleaning element 500 in FIG. 26 includes a slightly elastic or expandable mat 508 which carries a plurality of radially outwardly extending nibs or projections 506. The mat 508 is fixed by adhesive or the like to a core which is then mounted on one of the rotatable cylinders in the rotating apparatus described above.

Figure 27:
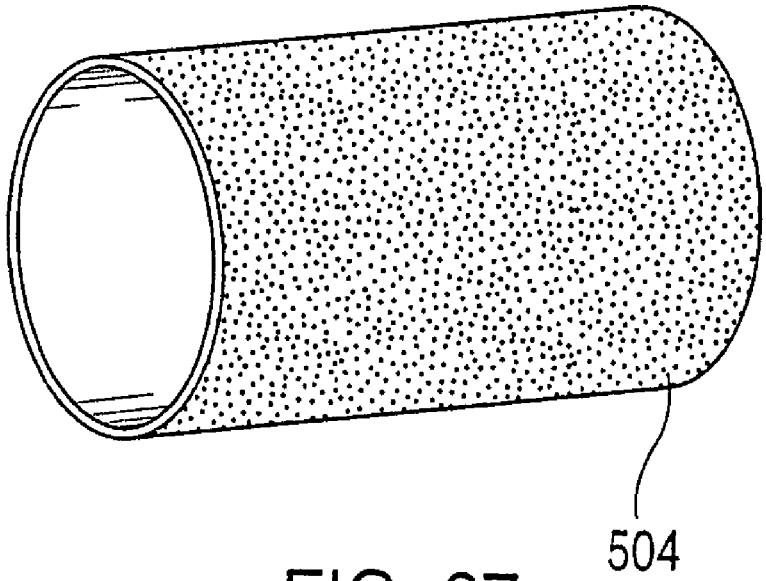
Figure 28:
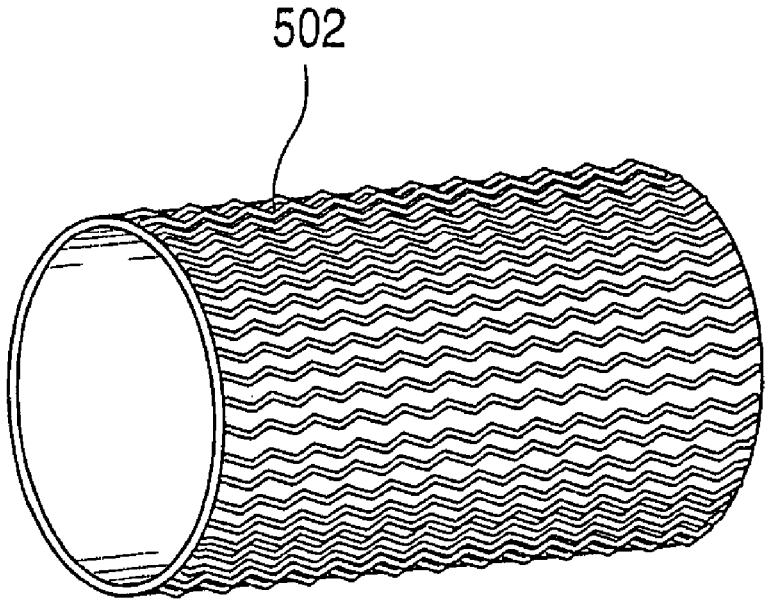

The cleaning element 502 in FIG. 27 depicts a cylindrical mat formed of a non-woven, sponge-like or foam material. The mat may be premoistened with a no-rinse soap or any cleaning, polishing or fluid disinfecting fluid.

Figure 29:
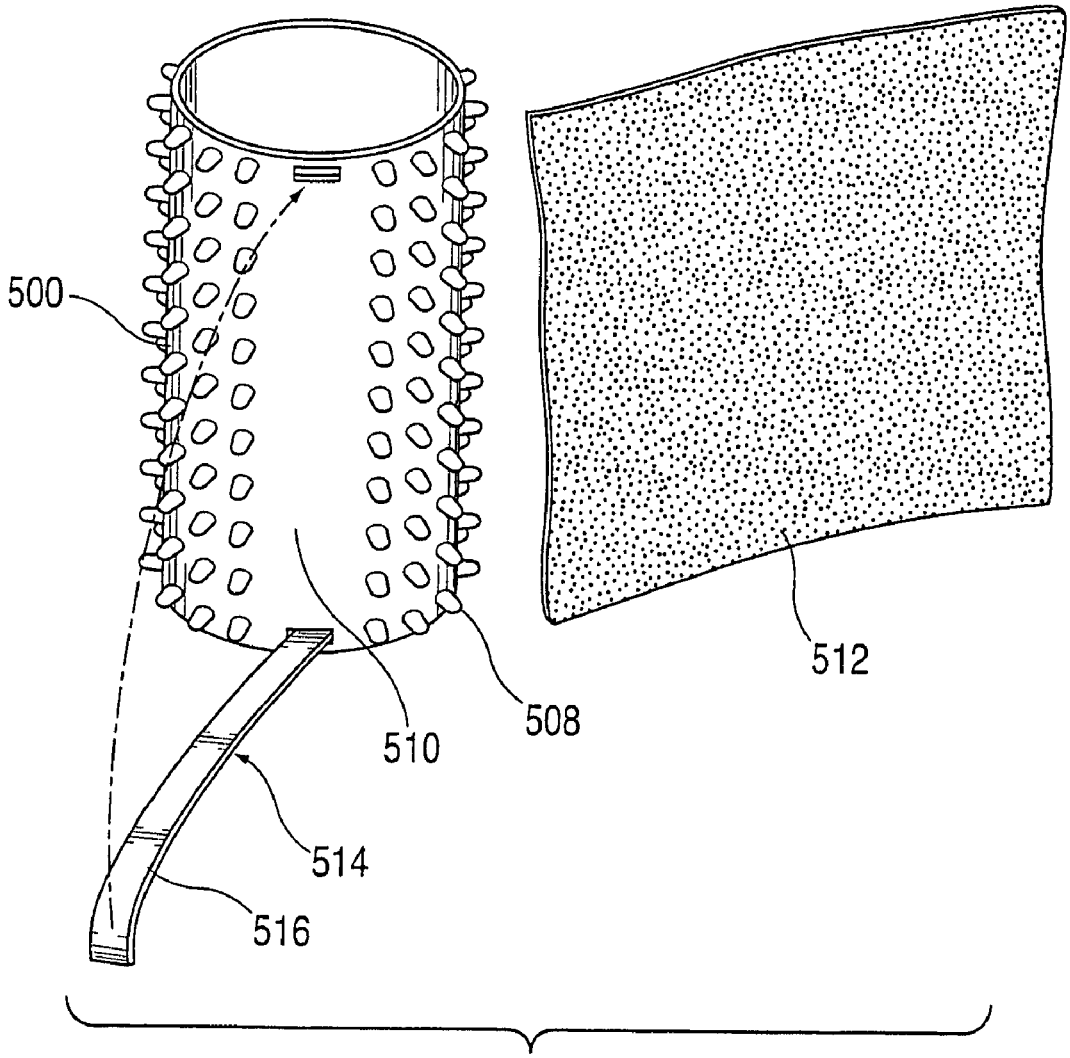
FIGS. 29 and 30 are exploded perspective views of modifications of other aspects of the cleaning element shown in FIGS. 26-28.

The cleaning element 504 in FIG. 29 depicts a directional fabric in which fibers mounted in a mat are oriented in one direction to pick up lint, debris or hair from pets and fabrics when the cleaning element 504 is mounted about one of the rotatable cylinders as described above and rotated in a first direction. Rotation of the element 504 in the opposite direction can be used to remove the accumulated debris from the element 504 by engagement with a finger, cleaning element or a hood and scraper attached to the body.

FIG. 29 depicts a modification to the cleaning element 500 in which the cleaning element 500 includes a space 510 which is at least partially void of the projections 508. A clamp, such as a hair barrette type clamp 514 is mounted on the mat and has a pivotal bar 516 which is extendable over the width of the cleaning element 500. A premoistened sheet 512 can be wound around the cleaning element 500 and the ends clamped in place by clamping of the pivotal bar 516 and the remainder of the clamp on the cleaning element 500. In this manner, the projections deform the sheet 512 and can be used to massage a pet while at the same time the premoistened wipe can be used to remove dirt, hair, dander, etc., from the pet.

Figure 30:
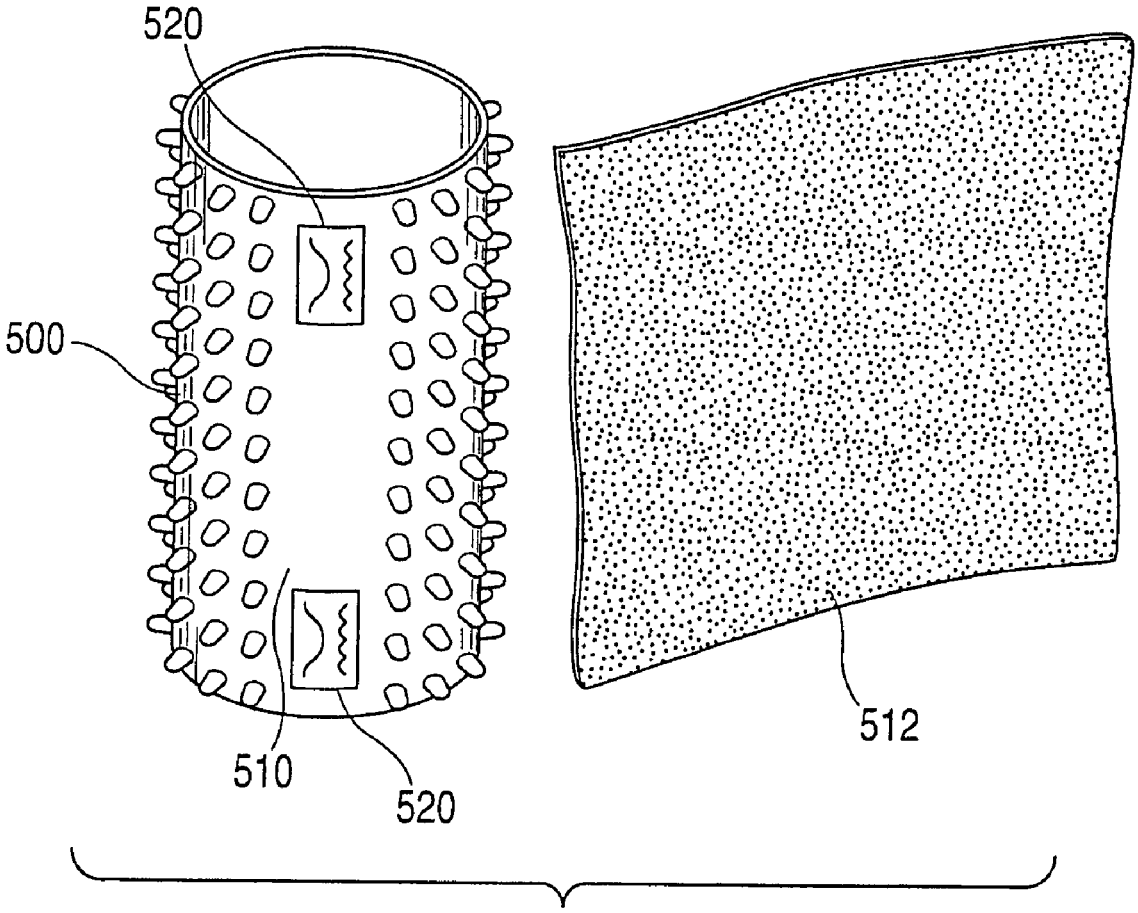

FIG. 30 depicts a similar modification to the cleaning element 500 in which the premoistened wipe 512 is clamped on the exterior of the cleaning element 500 by at least one and preferably a plurality of expandable rubber grippers 520 mounted in the cleaning element 500.

Figure 31A:
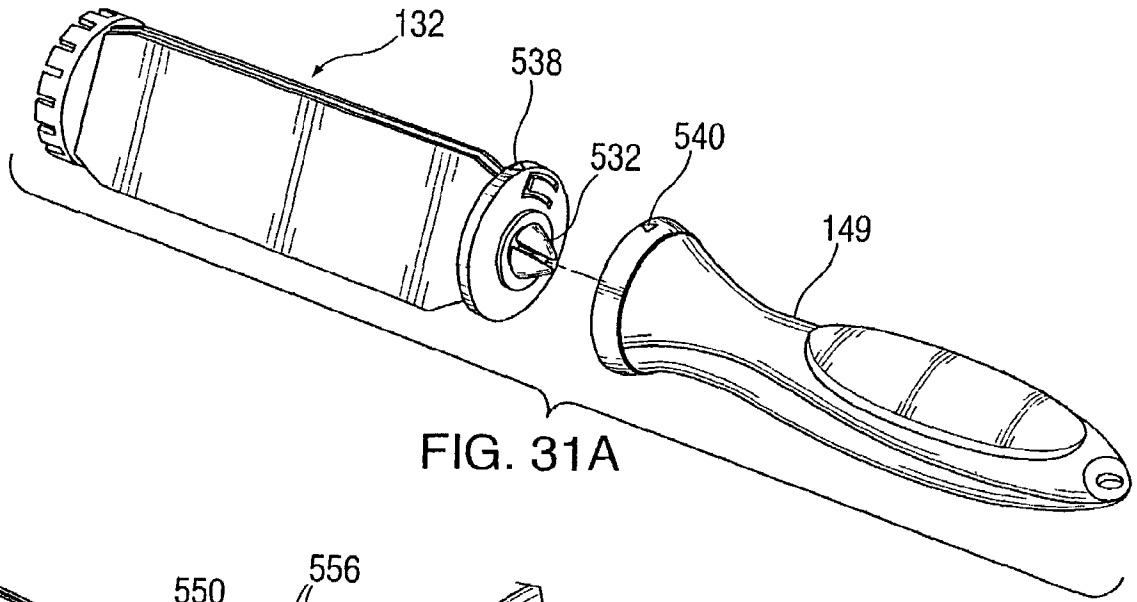
FIGS. 31A and 31B are exploded perspective views of another aspect of a lint roller apparatus with orienting capability according to the present invention.
Figure 31B:
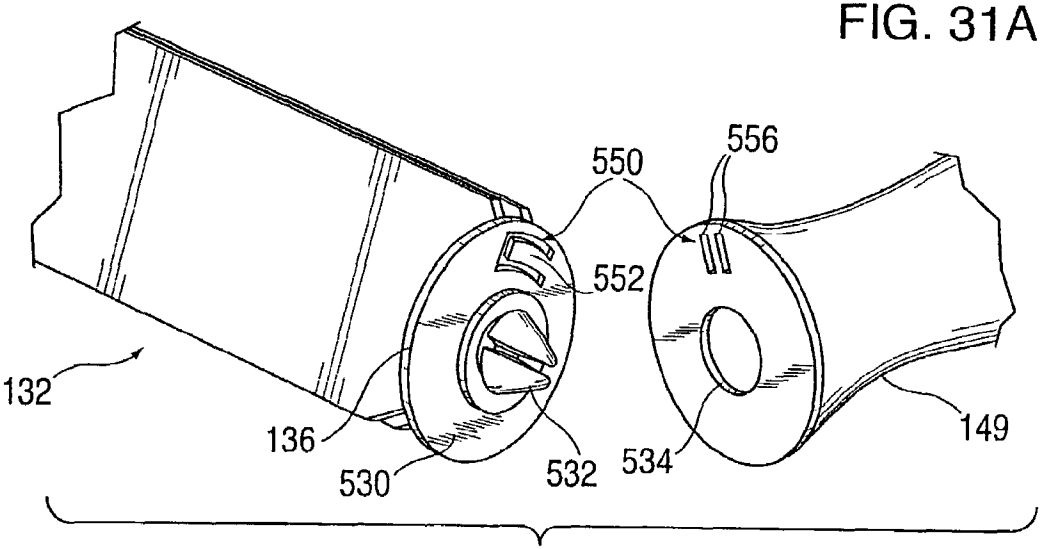

FIGS. 31A and 31B depict a modification to include the orienting means which can be employed with the apparatus 130 shown in FIG. 4. In this aspect of the invention, the collar 136 of the spindle 132 carries an end surface 530. A first connector part 532 is mounted on the end surface 530 and is engagable in an aperture 534 in the end surface 536 of the handle 149. Orienting marks or indicia 538 and 540 are mounted at an aligned position on the spindle 132 and the handle 149 as shown in FIG. 31A.

The stop means 550 in this aspect of the invention includes a flexible arm 552 moveably disposed within a slot 554 in the end surface 530 of the collar 136. The stop member 552 is positioned to engage at least one and preferably a pair of apertures 556 formed in the end surface 536 of the handle 149. As shown in FIG. 31B, the stop member 552 and the projections 556 are located at the 12 o'clock position on both the spindle 132 and the handle 149 to define the orienting position of the spindle 132 relative to the handle 149.

Figure 32:
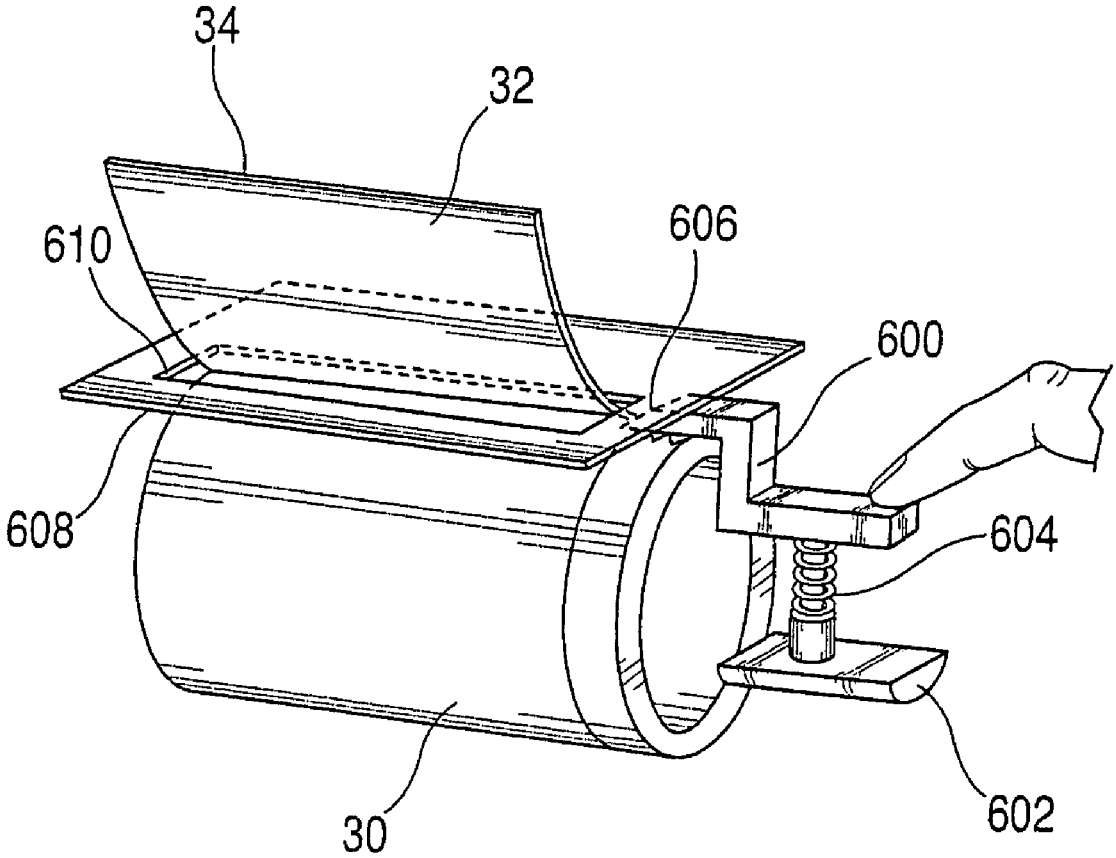
FIG. 32 is a pictorial representation of a modification to the edge scraper means shown in FIG. 17.

FIG. 32 depicts a modification to the edge separating blade members, such as the blade member 386 shown in FIG. 17. In this aspect, the blade member 600, which is carried on the handle 602, and normally biased outward by the biasing spring 604 as a knife edge 606 positioned, when the blade member 600 is depressed against the force of the biasing spring 604, to engage and separate the edge 34 of the outermost sheet 32 from the remainder of the roll 30 during rotation of the roll 30.

A hood or plate 608 is positioned over the lint roll 30 and is attached to the handle 342. The hood 608 includes an aperture or slot 610 positioned to receive the edge 34 of the outermost sheet 32 after the edge 32 has been detached from the roll 30 by the knife edge 606. After such detachment, the continued rotation of the lint roll 30 as described above, will cause the separated portion of the outermost sheet 32 to pass through the slot 610 to simplify and insure complete detachment of the outermost sheet 32 from the roll 30.

Figure 33:
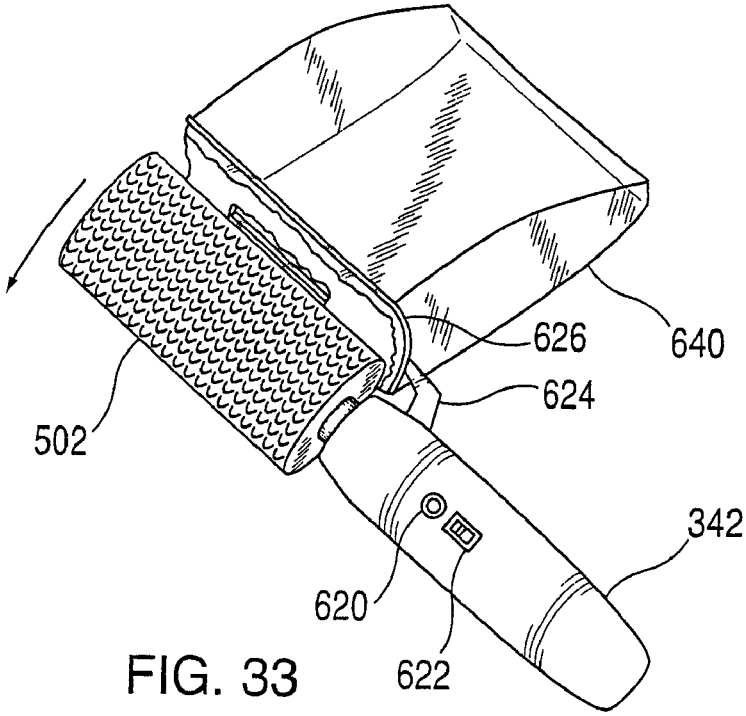
FIGS. 33, 34, and 35 are perspective, front elevational and a bottom view of the hood, respectively, of another aspect of the cleaning apparatus of the present invention.
Figure 35:
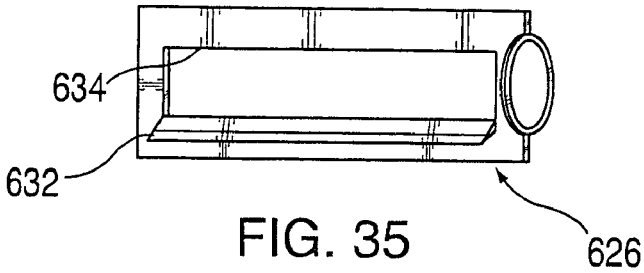

The cleaning apparatus shown in FIGS. 33, 35 includes a handle 342 and a rotatable support, not shown, for the directional fabric 502, as described above. The handle is provided, by way of example only, with a first stop/start or on/off switch 620 and a separate forward/reverse switch 622.

Figure 34:
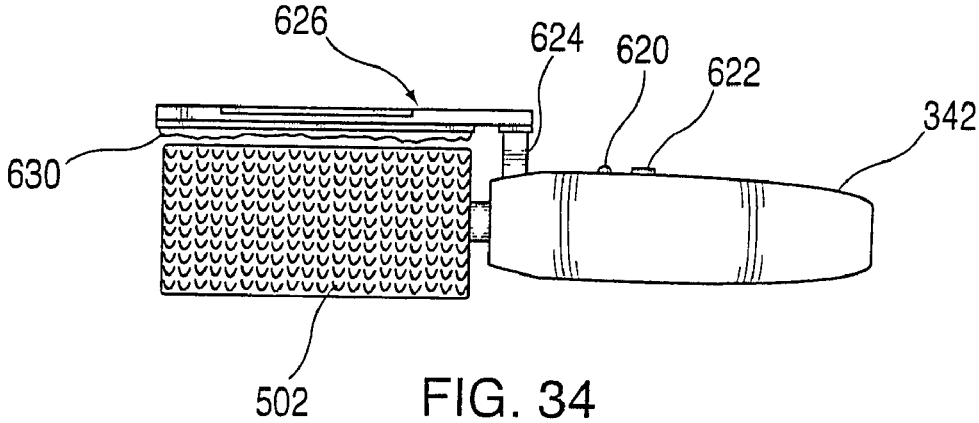

In this aspect, an arm 624 is fixed at one end to the handle 342 and is connected at an opposite end to a collection hood or compartment 626. The compartment carries, as shown in FIGS. 34 and 35, an additional cleaning element 630 which may be in the form of a rough fabric sheet as shown in FIG. 34 or a scraper blade 632 in FIG. 35. An opening 634 is formed in the bottom surface of the hood 626 as shown in FIG. 35 and opens to the interior of the hood 626 or to a bag 640 which can be secured at an open end by means of a tie member, elastic, etc., to the hood 626 to receive the debris removed from the directional fabric 502 when the motor contained within the handle 342 is moved in a reverse direction from the normal cleaning direction of rotation.

It will also be noted that in all aspects of the invention which mount a motor in the cleaning apparatus, a sound proofing material, such as the foam material used to form compressible ear plugs, which may have a high noise filtration (NRR) of 33 decibels, for example, may be mounted on or applied to the exterior or interior of the housing 342 depending on the suitability of the selected material for use as an external gripping surface or, when mounted internally within the handle 342, having suitable temperature resistance and electrical insulative properties.

What is claimed is:

1. A cleaning apparatus comprising:

a rotatable roll assembly including a wound roll with outwardly facing adhesive surfaces, the roll formed of a plurality of separable sheets, each defined by an edge separable from an adjacent sheet;

a support element rotatably supporting the roll assembly and including a handle and a support extending from the handle with the roll assembly mounted on the support; and first means including a projection on the handle, the first means being carried on the roll assembly, and second means including a recess carried on the roll assembly for selectively receiving the projection of the handle, the second means being carried on the support element, said first and second releasably engageable with one another only when said roll assembly is at a specific rotatable position relative to said support element during rotation of said roll assembly about said support element for rotatably orienting the edge of each sheet, as the edge of each sheet becomes the outermost edge of the roll, at a predetermined angular location relative to the support;

wherein said recess is formed in each of said separable sheets of said wound roll.

2. The apparatus of claim 1, wherein said roll assembly includes a core.

3. The apparatus of claim 1, wherein the support element comprises a one-piece body defined by the handle and the roll support.

4. The apparatus of claim 1, wherein the separable edge of each of the plurality sheets in the roll is radially aligned.

* * * * *